US007798950B2

(12) United States Patent
Kobayashi et al.

(10) Patent No.: US 7,798,950 B2
(45) Date of Patent: Sep. 21, 2010

(54) SHEET FINISHER, IMAGE FORMING APPARATUS, AND SHEET PROCESSING METHOD

(75) Inventors: Kazuhiro Kobayashi, Kanagawa (JP); Masahiro Tamura, Kanagawa (JP); Nobuyoshi Suzuki, Tokyo (JP); Shuuya Nagasako, Kanagawa (JP); Naohiro Kikkawa, Kanagawa (JP); Tomohiro Furuhashi, Kanagawa (JP); Hiroshi Maeda, Gifu (JP); Atsushi Kuriyama, Nagoya (JP); Makoto Hidaka, Tokyo (JP); Hitoshi Hattori, Tokyo (JP); Junichi Tokita, Kanagawa (JP); Akira Kunieda, Tokyo (JP); Takashi Saito, Kanagawa (JP); Ichiro Ichihashi, Inuyama (JP)

(73) Assignee: Ricoh Company, Limited, Tokyo (JP)

( * ) Notice: Subject to any disclaimer, the term of this patent is extended or adjusted under 35 U.S.C. 154(b) by 19 days.

(21) Appl. No.: 12/292,267

(22) Filed: Nov. 14, 2008

(65) Prior Publication Data

US 2009/0137374 A1 May 28, 2009

(30) Foreign Application Priority Data

Nov. 27, 2007 (JP) ..... 2007-306283
Aug. 5, 2008 (JP) ..... 2008-201912

(51) Int. Cl.
*B31F 1/10* (2006.01)

(52) U.S. Cl. ..... 493/406; 493/409; 493/417; 493/444; 270/20.1; 270/58.07

(58) Field of Classification Search ..... 493/406, 493/405, 409, 416, 417, 442–445, 454; 270/20.1, 270/32, 58.07
See application file for complete search history.

(56) References Cited

U.S. PATENT DOCUMENTS 6,318,008 B1 * 11/2001 Funk et al. ..... 38/7
6,511,407 B2 * 1/2003 Wahl ..... 493/405
6,709,375 B2 * 3/2004 Groenenberg et al. ..... 493/442
7,147,598 B2 * 12/2006 Fujimoto et al. ..... 493/405
7,285,084 B2 * 10/2007 Fujimoto et al. ..... 493/442

(Continued)

FOREIGN PATENT DOCUMENTS

JP 62-016987 1/1987

(Continued)

OTHER PUBLICATIONS

Abstract of JP 10-181990 published Jul. 7, 1998.

(Continued)

*Primary Examiner*—Christopher Harmon
(74) *Attorney, Agent, or Firm*—Harness, Dickey & Pierce, P.L.C.

(57) ABSTRACT

A folding unit folds a sheet. A pressing unit presses a folded side of the folded sheet. A driving unit causes the pressing unit to slide in a direction perpendicular to a sheet conveying direction. A control unit independently sets number of slides at which the pressing unit is to slide on each of a plurality of sections of the folded side depending on a distance of each of the sections from a reference position, and controls the driving unit so as to slide in each of the sections for the number of slides set for that section.

18 Claims, 22 Drawing Sheets

U.S. PATENT DOCUMENTS

| | | | | |
|---|---|---|---|---|
| 7,562,866 | B2 * | 7/2009 | Hayashi | 270/58.07 |
| 2006/0261544 | A1 | 11/2006 | Tamura et al. | |
| 2006/0263174 | A1 * | 11/2006 | Oikawa et al. | 412/33 |
| 2007/0045919 | A1 * | 3/2007 | Hayashi | 270/32 |
| 2007/0045926 | A1 * | 3/2007 | Fukatsu et al. | 270/58.07 |
| 2007/0051219 | A1 | 3/2007 | Tamura et al. | |
| 2007/0060459 | A1 * | 3/2007 | Hayashi | 493/434 |
| 2007/0138726 | A1 | 6/2007 | Tamura et al. | |
| 2007/0147925 | A1 | 6/2007 | Nomura et al. | |
| 2007/0235917 | A1 | 10/2007 | Nagasako et al. | |
| 2008/0006993 | A1 | 1/2008 | Nomura et al. | |
| 2008/0048380 | A1 | 2/2008 | Ichihashi et al. | |
| 2008/0067730 | A1 | 3/2008 | Suzuki et al. | |

FOREIGN PATENT DOCUMENTS

| | | |
|---|---|---|
| JP | 2001-019269 | 1/2001 |
| JP | 2001-163519 | 6/2001 |
| JP | 2001-206629 | 7/2001 |
| JP | 3566492 | 6/2004 |
| JP | 3746472 | 12/2005 |

OTHER PUBLICATIONS

Abstract of JP 2004-059307 published Feb. 26, 2004.

* cited by examiner

SHEET FINISHER, IMAGE FORMING APPARATUS, AND SHEET PROCESSING METHOD

CROSS-REFERENCE TO RELATED APPLICATIONS

The present application claims priority to and incorporates by reference the entire contents of Japanese priority document 2007-306283 filed in Japan on Nov. 27, 2007 and Japanese priority document 2008-201912 filed in Japan on Aug. 5, 2008.

BACKGROUND OF THE INVENTION

1. Field of the Invention

The present invention relates to a sheet finisher, an image forming apparatus including the sheet finisher, and a sheet processing method.

2. Description of the Related Art

With the development of multi-functional sheet finishers, sheet finishers with both a side-stitch function and a saddle-stitch function have appeared. In the saddle-stitch function, a set of sheet-like recording mediums (hereinafter, "sheets") is stapled in the center and the stapled set of sheets is half-folded. Japanese Patent Application Laid-open No. 2001-163519 and Japanese Patent Application Laid-open No. 2001-206629 disclose examples of the sheet finishers with the saddle-stitch function. In most of the sheet finishers with the saddle-stitch function, a folding unit that folds the set of sheets includes at least one pair of rollers called pressure rollers and a plate member called folding plate. More particularly, the folding plate is aligned with a line to be folded of the set of sheets, and inserts the set of sheets into a nip between the pressure rollers. Thus, a crease is made along the line to be folded on the set of sheets with the nip.

Some folding units include a first pair of pressure rollers and a second pair of pressure rollers. The set of sheets is pressed twice with the first pressure rollers and the second pressure rollers, which makes a stronger crease. Japanese Patent No. 3566492 and Japanese Patent Application Laid-open No. 2001-19269 disclose examples of folding units including a plurality of pairs of pressure rollers. However, even when the set of sheets is pressed twice, it is difficult to make a crease strong enough due to a short pressing time and a low pressing force. Because a rotation axis of the pressure rollers runs parallel to a direction perpendicular to a sheet conveying direction, a folded side of the set of sheets is pressed in the nip between the pressure rollers only for a short time. Moreover, because the pressure rollers nip the entire folded side at the same time, the pressing force on the set of sheets is distributed, i.e., the pressing force per unit area is low.

Sheet finishers disclosed in Japanese Patent Application No. 3746472 and Japanese Patent Application Laid-open No. S62-16987 are similar to the sheet finishers disclosed in Japanese Patent Application Laid-open No. 2001-163519 and Japanese Patent Application Laid-open No. 2001-206629, except that the sheet finishers additionally include a slidable pressure roller to make a stronger crease. The slidable pressure roller is arranged near an ejection port downstream of the pressure rollers. Upon receiving the set of sheets from the pressure rollers, the slidable pressure roller re-presses the set of sheets while sliding on the folded side in the direction perpendicular to the sheet conveying direction, i.e., along the line of crease by an operation of a screw. This configuration makes it possible to a stronger crease.

Because the folded side is pressed with the slidable pressure roller sliding in the direction perpendicular to the sheet conveying direction, the pressing force is applied only at one point of the folded side making a contact with the slidable pressure roller at a time. Because the slidable pressure roller slides on the folded side, the entire folded side is pressed with the high pressing force. As a result, the strong crease is made on the set of sheets.

Moreover, because the slidable pressure roller slides by the rotation of the screw, the folded side is pressed with the pressing force high enough and the crease strong enough is made on the set of sheets. This also results in decreasing a thickness of the folded side. However, because the rotation of the screw is used to slide the slidable pressure roller, the sliding speed is slow, which results in low productivity.

SUMMARY OF THE INVENTION

It is an object of the present invention to at least partially solve the problems in the conventional technology.

According to an aspect of the present invention, there is provided an apparatus for folding a sheet including a folding unit that folds the sheet along a folding line thereby obtaining a folded sheet having a folded side; a pressing unit that presses the folded side of the folded sheet; a driving unit that causes the pressing unit to slide in a direction substantially perpendicular to a conveying direction of the sheet; and a control unit that independently sets number of slides at which the pressing unit is to slide on each of a plurality of sections of the folded side depending on a distance of each of the sections from a reference position, and controls the driving unit so as to slide in each of the sections for the number of slides set for that section.

According to another aspect of the present invention, there is provided an image forming apparatus that includes the above apparatus for folding a sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
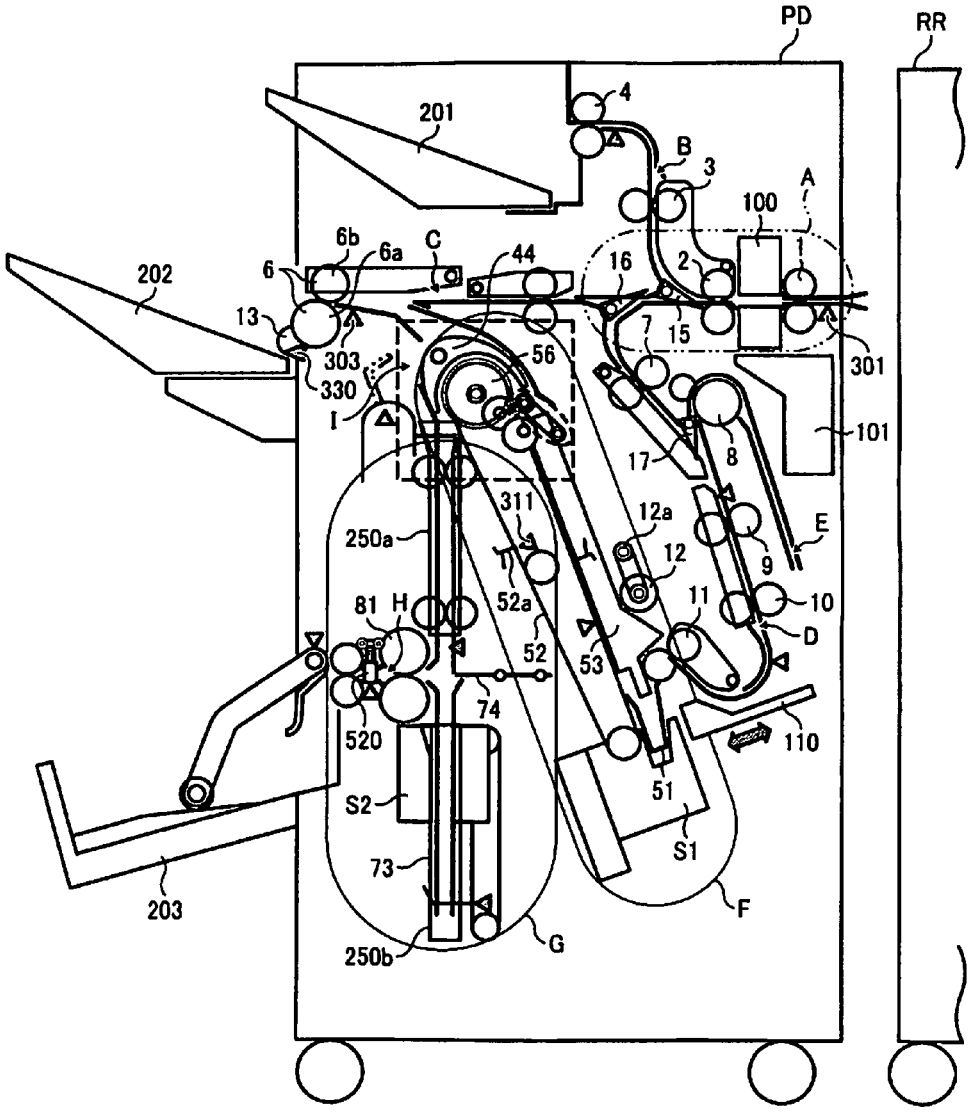
FIG. 1 is a schematic diagram of a system including a sheet finisher and an image forming apparatus according to an embodiment of the present invention.

FIG. 1 is a schematic diagram of the structure of a system including a sheet finisher PD as a sheet post-processing device and an image forming apparatus PR according to an embodiment of the present invention.

The sheet finisher PD is attached to a side of the image forming apparatus PR. A sheet ejected from the image forming apparatus PR is conveyed to the sheet finisher PD. The sheet passes through a conveyer path A for single-sheet processing (e.g., a punching unit 100 is located near the conveyer path A). After that, the sheet is conveyed by the operation of switching claws 15 and 16 to any one of a conveyer path B connecting to an upper tray 201, a conveyer path C connecting to a shift tray 202, a conveyer path D connecting to a side-stitch tray F for alignment and stapling.

The image forming apparatus PR includes, although not shown in the drawings, an image processing circuit for converting received image data into printable image data, an optical writing device that writes a latent image with a light on a photosensitive element based on an image signal received from the image processing circuit, a developing device that develops the latent image to a toner image, a transferring device that transfers the toner image onto a sheet, and a fixing device that fixes the tonner image on the sheet. The image forming apparatus PR sends the sheet with the fixed toner image to the sheet finisher PD. Upon receiving the sheet from the image forming apparatus PR, the sheet finisher PD performs a certain post-processing with the sheet. Although the above explanation is made assuming that the image forming apparatus PR is an electrophotographic machine, the image forming apparatus PR can be any type of image forming apparatus such as an inkjet machine or a thermal-transfer machine.

After the alignment and stapling is performed at the side-stitch tray F with the sheet that has been passed through the conveyer paths A and D, the sheet is conveyed by the operation of a guiding member 44 to either the conveyer path C connecting to the shift tray 202 or a saddle-stitch tray G for saddle-stitch and folding. If the sheet is conveyed to the saddle-stitch tray G, the sheet is folded or the like at the saddle-stitch tray G. The folded sheet is conveyed to a conveyer path H and ejected onto a lower tray 203. The conveyer path D is provided with a switching claw 17 that keeps a position as shown in FIG. 1 by support of a low load spring (not shown). After the back end of the sheet passes the switching claw 17 while the sheet is conveyed by rotation of a pair of conveyer rollers 7, the sheet is reversed along a turn guiding member 8 by reverse-rotation of a pair of conveyer rollers 9, in some cases, together with reverse-rotation of at least one of a pair of conveyer rollers 10 and a pair of stapled-sheet conveyer rollers 11 (brush rollers). Thus, the sheet is conveyed with the back end ahead to a sheet accommodating unit E for pre-stacking. When the next sheet is conveyed to the sheet accommodating unit E, the two sheets are conveyed out of the sheet accommodating unit E overlapped with each other. It is possible to convey three or more sheets overlapped with one another by repeating those operations.

An entrance sensor 301 that detects the sheet coming from the image forming apparatus PR, a pair of entrance rollers 1, the punching unit 100, a punch-waste hopper 101, a pair of conveyer rollers 2, and the switching claws 15 and 16 are arranged near the conveyer path A in this order, with the entrance sensor 301 being closest to the image forming apparatus PR. The switching claws 15 and 16 keep positions as shown in FIG. 1 by support of springs (not shown). When corresponding solenoids (not shown) are turned ON, the switching claws 15 and 16 switch ON. The sheet is conveyed to one of the conveyer paths B, C, and D depending on a switching pattern of the switching claws 15 and 16.

When the sheet is to be conveyed to the conveyer path B, the solenoids are kept OFF, and thereby the switching claws 15 and 16 are in the positions shown in FIG. 1. As a result, the sheet is conveyed to the shift tray 202 though a pair of conveyer rollers 3 and a pair of ejection rollers 4. When the sheet is to be conveyed to the conveyer path C, the both solenoids are turned ON so that the switching claw 15 turns upward and the switching claw 16 turns downward. Thus, the sheet is conveyed to the shift tray 202 through a pair of ejection rollers 6. When the sheet is to be conveyed to the conveyer path D, the solenoid for the switching claw 16 is turned OFF and the solenoid for the switching claw 15 is turned ON so that the switching claw 15 turns upward and the switching claw 16 turned downward.

The sheet finisher PD can perform various sheet processing including punching using the punching unit 100, alignment and side stitch using a pair of jogger fences 53 and a side-stitch stapler S1, alignment and saddle stitch using an upper saddle-stitch jogger fence 250*a*, a lower saddle-stitch jogger fence 250*b*, and a saddle-stitch stapler S2, sorting using the shift tray 202, half-folding using a folding plate 74 and a pair of first pressure rollers 81. Moreover, the sheet finisher PD can perform slide-pressing as a subsequent process of the half-folding to make a crease on the folded sheet set stronger.

As show in FIG. 1, a sheet ejecting unit that ejects the sheets on the shift tray 202 includes the ejection rollers 6 (6*a*, 6*b*), a reverse roller 13, a sheet sensor 330, the shift tray 202, a shifting mechanism that shifts the shift tray 202 back and forth in a direction perpendicular to the sheet conveying direction, and a lifting mechanism that lifts the shift tray 202 up and down.

The reverse roller 13 is made of sponge. When the sheet is ejected by the ejection rollers 6, the reverse roller 13 comes in contact with the sheet so that the back end of the sheet abuts against an end fence, which makes the sheets stacked on the shift tray 202 aligned.

The reverse roller 13 rotates by the rotation of the ejection rollers 6. There is a lift-up stop switch (not shown) near the reverse roller 13. When the shift tray 202 lifts up and pushes the reverse roller 13 up, the lift-up stop switch turns ON and a shift-tray lifting motor (not shown) stops. Thus, the shift tray 202 cannot move up beyond a predetermined position.

The sheet sensor 330 is arranged near the reverse roller 13. The sheet sensor 330 detects a position of the top one out of sheets stacked on the shift tray 202. When it is determined using the sheet sensor 330 that the position of the top sheet reaches a predetermined height, the shift tray 202 moves down by a predetermined amount by the action of the shift-tray lifting motor so that the position of the top sheet is always at the same level.

The ejection rollers 6 are formed with a driving roller 6*a* and a driven roller 6*b*. The driven roller 6*b* is arranged upstream of the driving roller 6*a*, and is rotatably attached to a free end of an open/close guiding plate. The open/close guiding plate is attached to the sheet finisher PD rotatably around the other end, arranged with the free end being closer to the shift tray 202. The driven roller 6*b* comes in contact with the driving roller 6*a* under the weight of the driven roller 6*b* or by a biasing force, and the sheet is ejected through between the driving roller 6*a* and the driven roller 6*b*. When stapled sheets are to be ejected, the open/close guiding plate moves up to a predetermined position, and then moves down at predetermined timing decided based on a detection signal from an ejection sensor 303. The predetermined position is decided based on a detection signal from a guiding-plate open/close sensor (not shown). The open/close guiding plate moves up, driven by a guiding-plate open/close motor (not shown).

When the sheet is conveyed to the side-stitch tray F by the rotation of the stapled-sheet conveyer rollers 11, the sheet is stacked on the side-stitch tray F. More particularly, the sheet goes backward by rotation of a reverse roller 12 in the vertical direction (i.e., the sheet conveying direction), and abut against an end fence 51, which makes the sheets stacked on the side-stitch tray F aligned. A direction perpendicular to the sheet conveying direction (i.e., the sheet-width direction) is aligned with the jogger fences 53. When it is determined based on a staple signal from a control circuit 350 that a last one of a set of sheets is stacked on the side-stitch tray F, the side-stitch stapler S1 stapes the set of sheets. A sheet pressing member 110 presses a side of the set of sheets when the side-stitch stapler S1 staples the sheets.

A home position (HP) of a lifting claw 52*a* is detected with an ejection-belt HP sensor 311. The ejection-belt HP sensor 311 turns ON/OFF by operation of the lifting claw 52*a* attached to a lifting belt 52. Two lifting claws 52*a* are attached to an outer surface of the lifting belt 52, with the lifting claws 52*a* being opposed to each other. The two lifting claws 52*a* alternately lift the set of sheets out of the side-stitch tray F.

The lifting belt 52 rotates between a driving pulley and a driven pulley along a center line of the aligned sheet width. A plurality of lifting rollers 56 are attached rotatably to a driving shaft, working as driven rollers. The lifting rollers 56 are arranged symmetric to each other with respect to the lifting belt 52.

The reverse roller 12 swings around a fulcrum 12*a* by a tapping solenoid, which causes the back end of the sheets stacked on the side-stitch tray F to abut against the end fence 51. The reverse roller 12 rotates counterclockwise. The pair of jogger fences 53 is arranged so that both width-direction sides of the stacked sheets put between them. The jogger fences 53 slide in the sheet-width direction back and forth via a timing belt (not shown) by positive-driving or negative-driving of a jogger motor (not shown). The side-stitch stapler S1 moves to a target position in the sheet-width direction via a timing belt (not shown) by positive-driving or negative-driving of a stapler moving motor (not shown) to staple the target position of the sheet side. As shown in FIG. 1, the sheet finisher PD includes a movable backend fence 73 and a slidable pressure roller 520.

A saddle-stitch mechanism related to the slide-pressing process is explained below. A side-stitch mechanism is not explained, because the side-stitch mechanism is not a feature of the sheet finisher PD.

Figure 2:
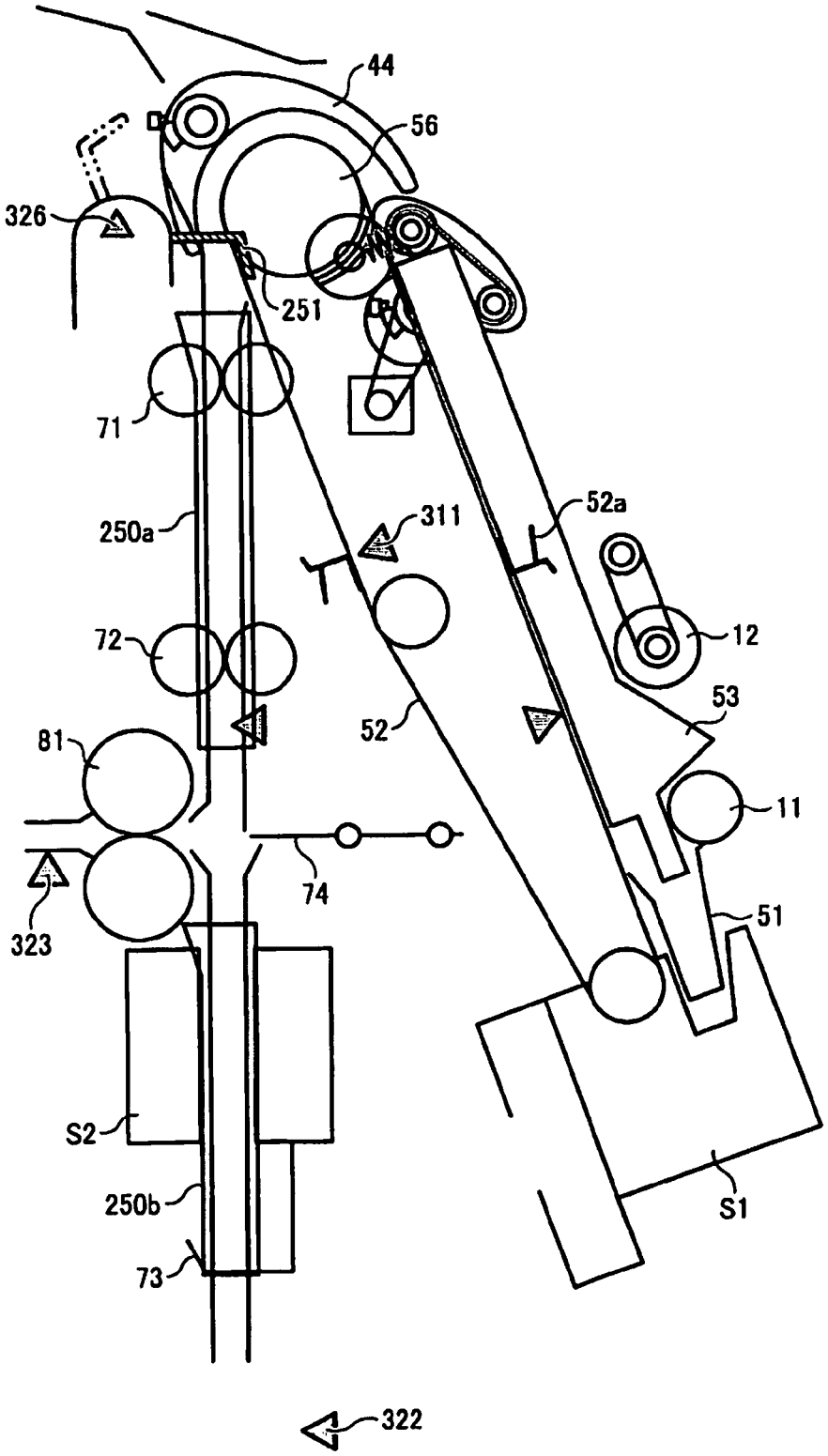
FIG. 2 is a schematic diagram of a side-stitch tray and a saddle-stitch tray shown in FIG. 1, viewed from the front side of the sheet finisher.
Figure 3:
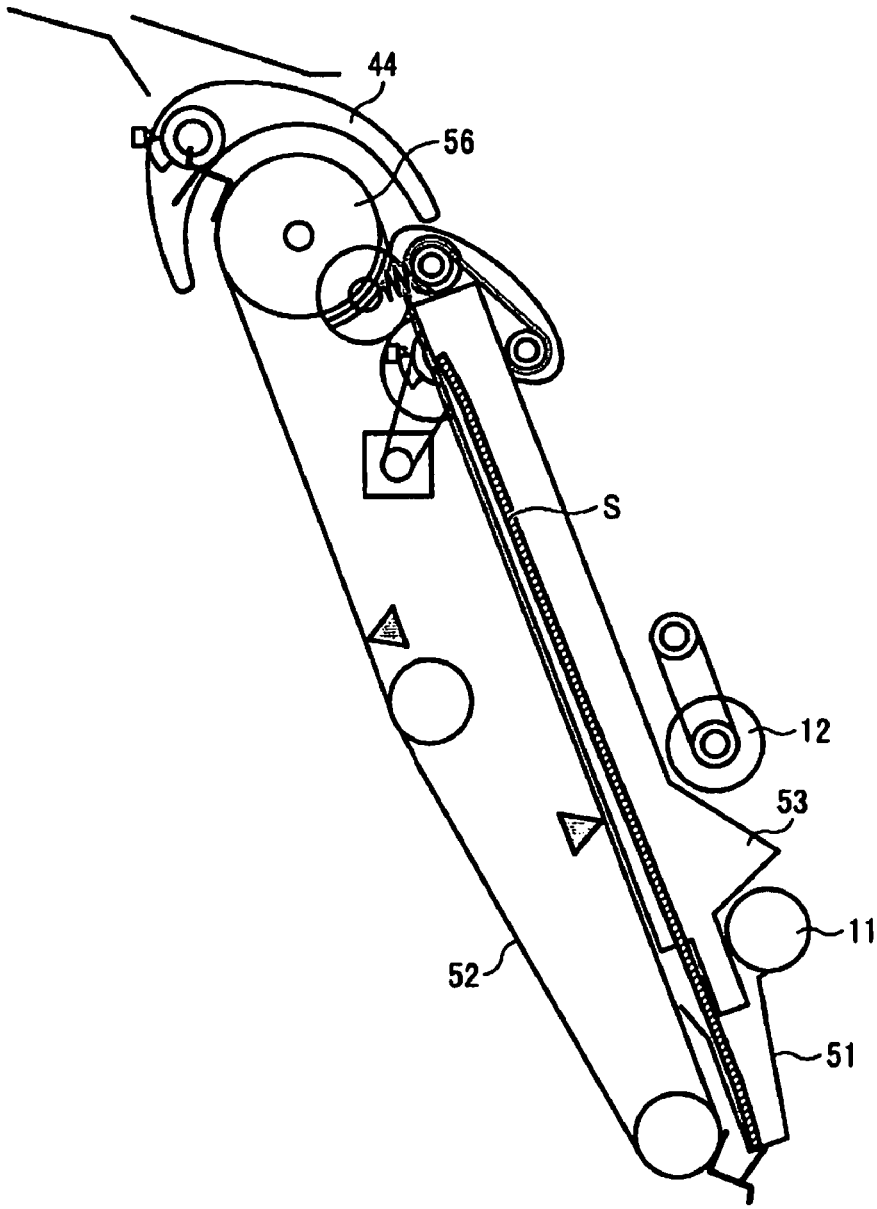
FIGS. 3 to 10 are schematic diagrams for explaining operations in a saddle-stitch mode according to the embodiment.

FIG. 2 is a schematic diagram of the side-stitch tray F and the saddle-stitch tray G viewed from the front side of the sheet finisher PD. FIGS. 3 to 10 are schematic diagrams for explaining operations in a saddle-stitch mode. The saddle-stitch mode is explained below.

It is assumed that the sheet is conveyed to the conveyer path D by the operation of the switching claws 15 and 16, and then is conveyed to the side-stitch tray F by the operation of the conveyer rollers 7, 9, and 10, and the stapled-sheet conveyer rollers 11. At the side-stitch tray F, the sheet is aligned with the stapled-sheet conveyer rollers 11 both in the saddle-stitch mode and the side-stitch mode (see FIG. 3). In other words, the operations in the saddle-stitch mode and the stapling mode are same before a set of sheets is stapled in the side-stitch mode.

Figure 4:
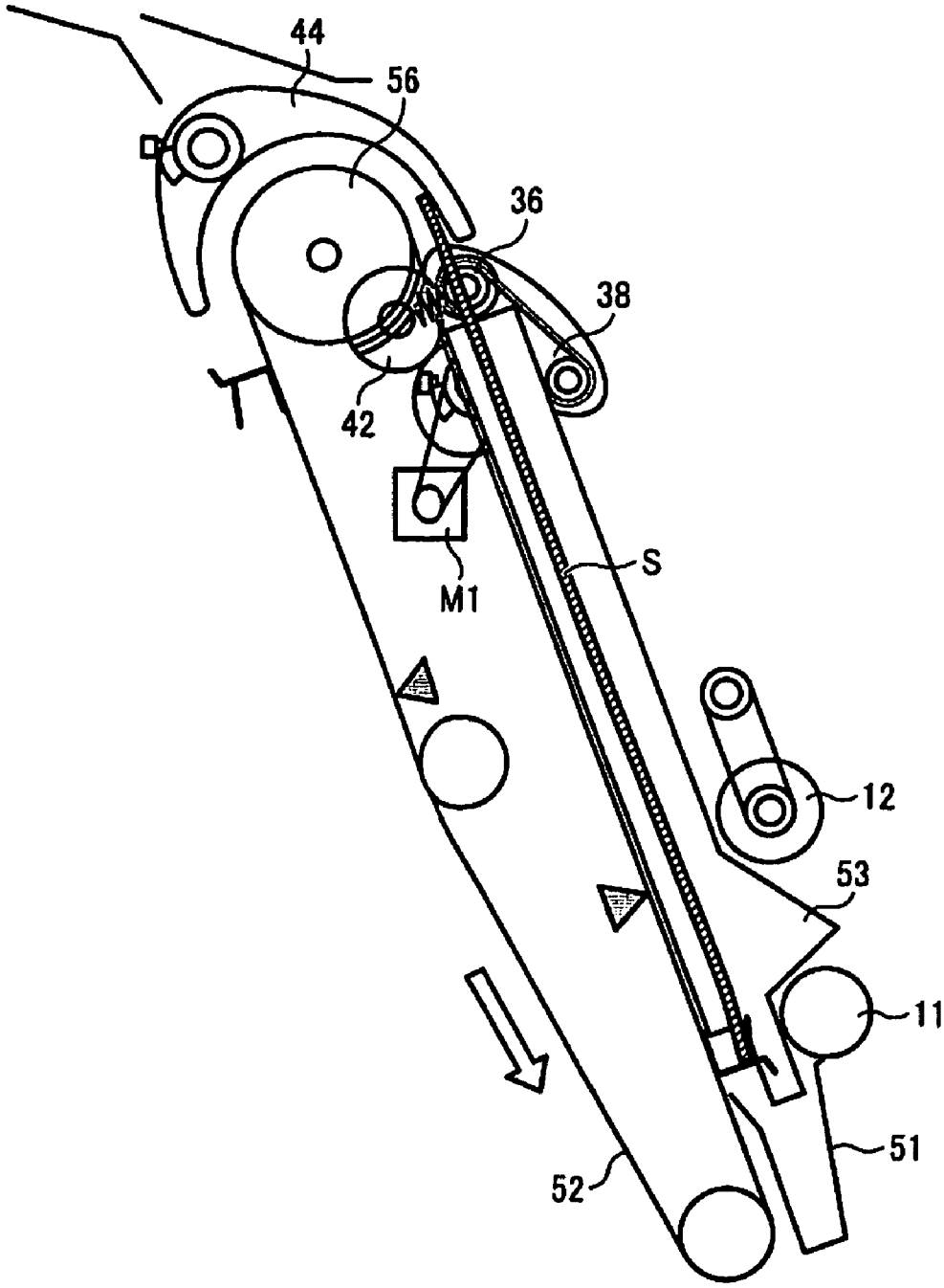
Figure 5:
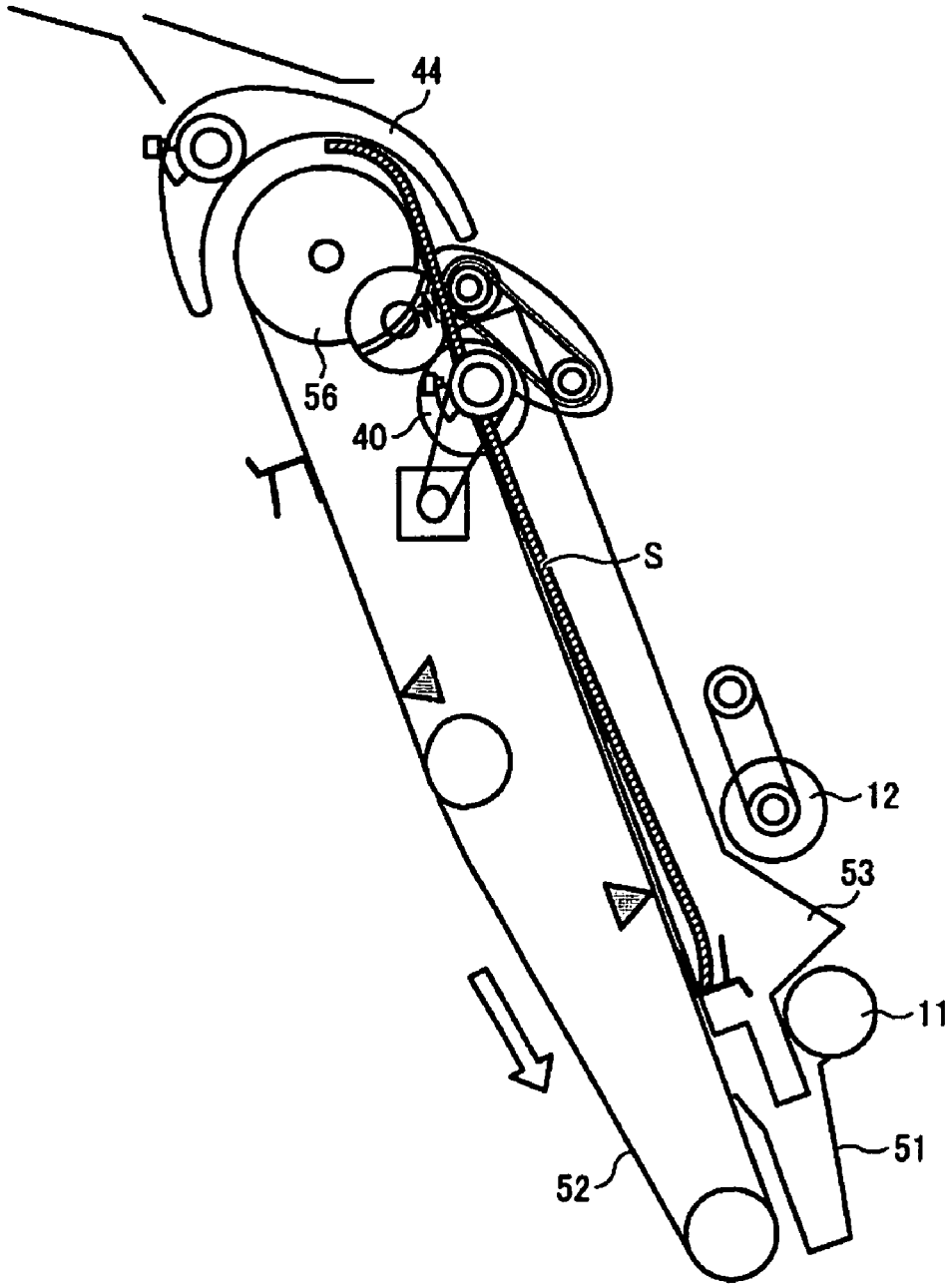

After a set of sheets (hereinafter, "sheet set S") is roughly aligned at the side-stitch tray F, the sheet set S is lifted up with the lifting claw 52*a*. As shown in FIG. 4, a front end of the sheet set S is conveyed to a position between an inner circumference of the guiding member 44 and the lifting rollers 56, passed between a roller 36 and a driven roller 42 that are in an open position in which a distance between the roller 36 and the driven roller 42 is wider than a thick of the sheet set S. After that, the roller 36 swings to a close position by a motor M1 and a cam 40, and the sheet set S is nipped by the roller 36 and the driven roller 42 with a predetermined pressure. The sheet set S is then conveyed to the saddle-stitch tray G by the rotation of the roller 36 and the lifting rollers 56 as shown in FIG. 5. The roller 36 rotates by a timing belt 38. The lifting rollers 56 that are attached to the driving shaft of the lifting belt 52 rotate in synchronization with the lifting belt 52.

Figure 6:
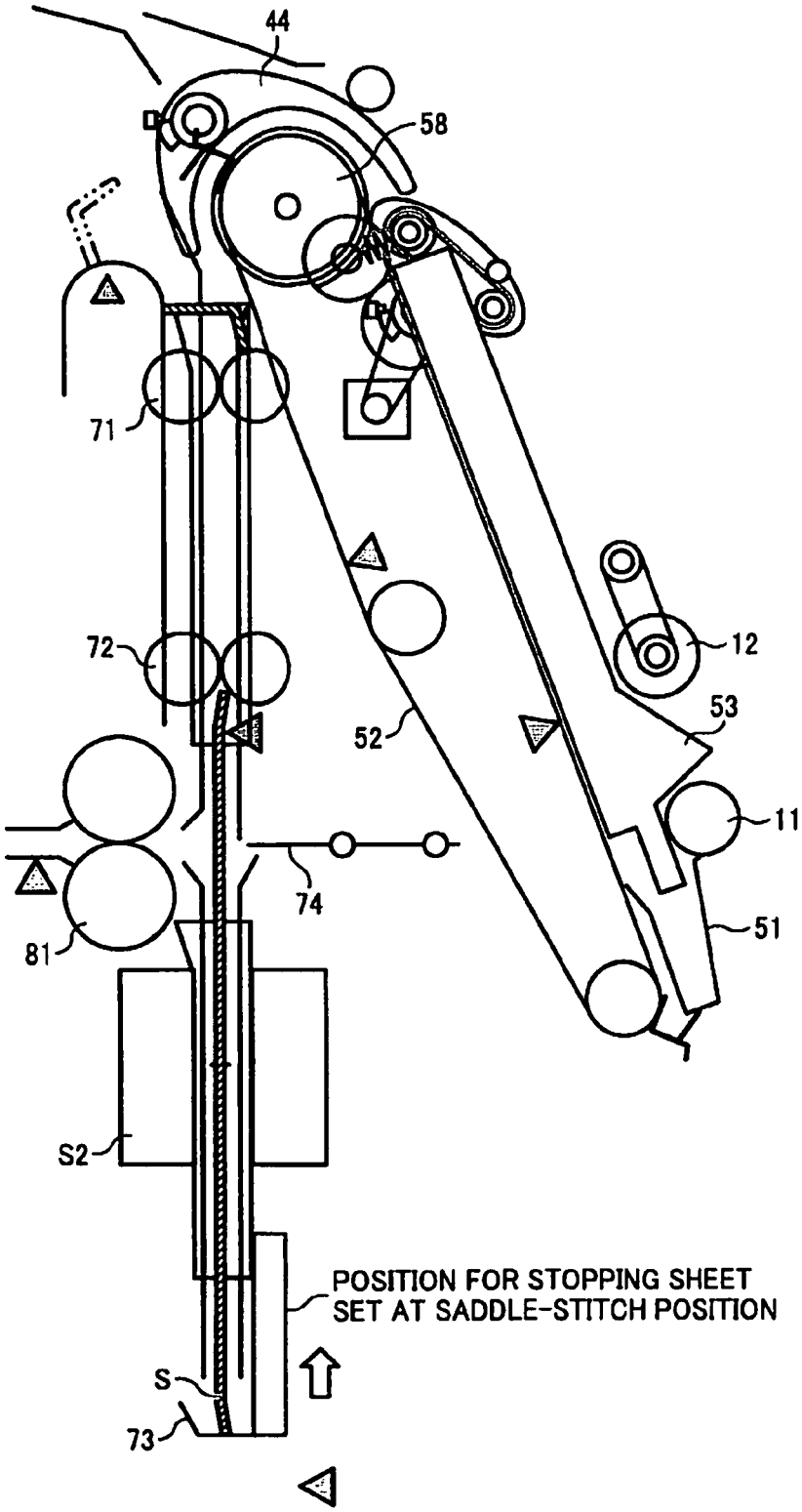
Figure 7:
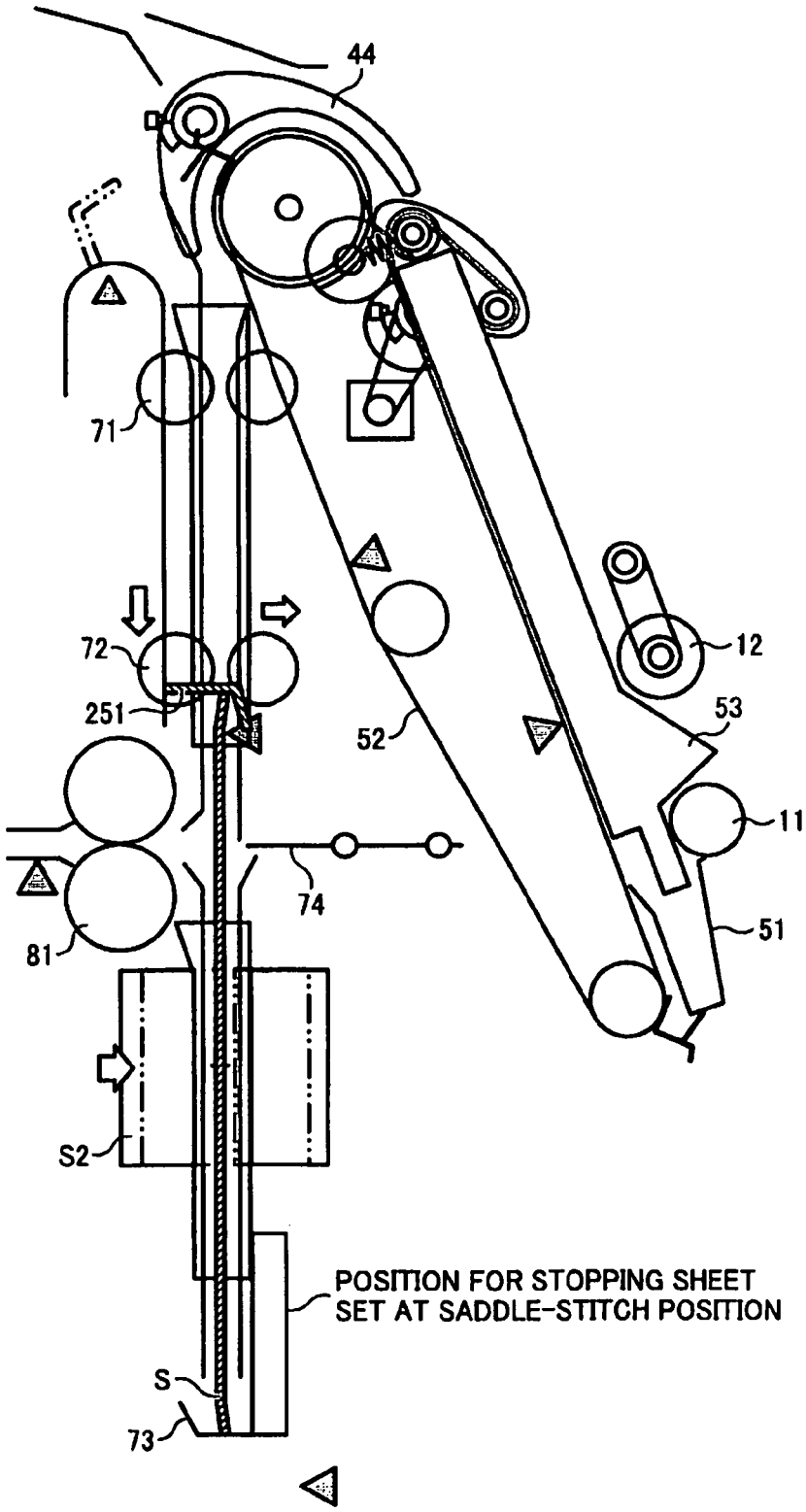

In the saddle-stitch tray G, the sheet set S is conveyed with a pair of upper conveyer rollers 71 and a pair of lower conveyer rollers 72 to a position at which the front end of the sheet set S abuts against the movable backend fence 73 as shown in FIG. 6. The position of the movable backend fence 73 depends on a length of the sheets. When the front end of the sheet set S abuts against the movable backend fence 73, the lower conveyer rollers 72 apart from each other and a back end of the sheet set S is tapped with a tapping claw 251 as shown in FIG. 7. Thus, the sheet set S is finely aligned with respect to the sheet conveying direction. In this manner, even when the alignment of the sheet set S breaks during the travel from the side-stitch tray F to the movable backend fence 73, the tapping with the tapping claw 251 makes the sheet set S aligned.

The sheet set S, the movable backend fence 73, and the relative members shown in FIG. 7 are in saddle-stitch positions. The sheet set S is aligned with respect to its width with the upper saddle-stitch jogger fence 250*a* and the lower saddle-stitch jogger fence 250*b*. The saddle-stitch stapler S2 staples a center position of the aligned sheet set S. It is noted that the position of the movable backend fence 73 is decided based on a pulse from a backend-fence HP sensor 322 shown in FIG. 2, and the position of the tapping claw 251 is decided based on a pulse from a tapping-claw HP sensor 326 shown in FIG. 2.

Figure 8:
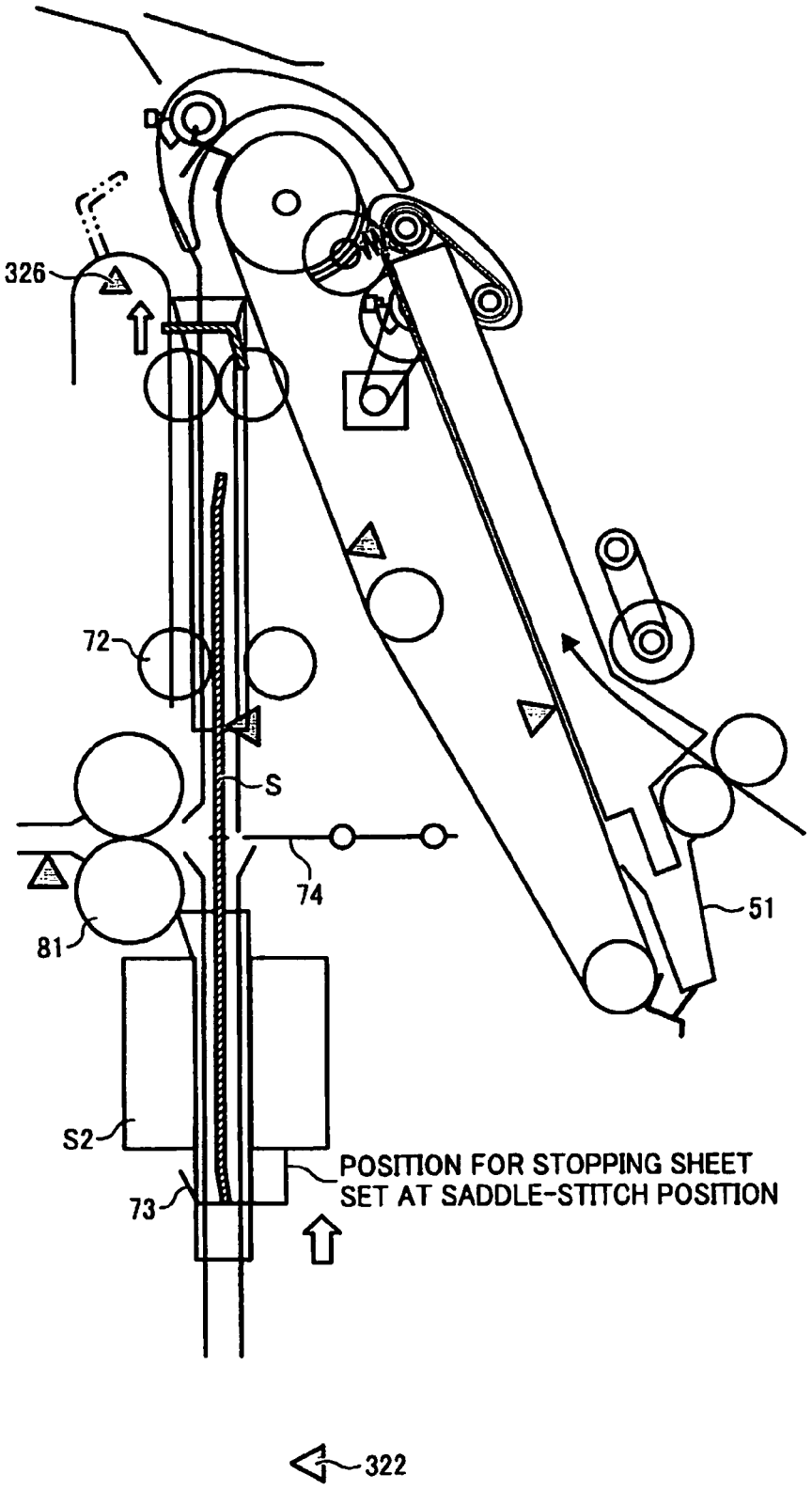
Figure 9:
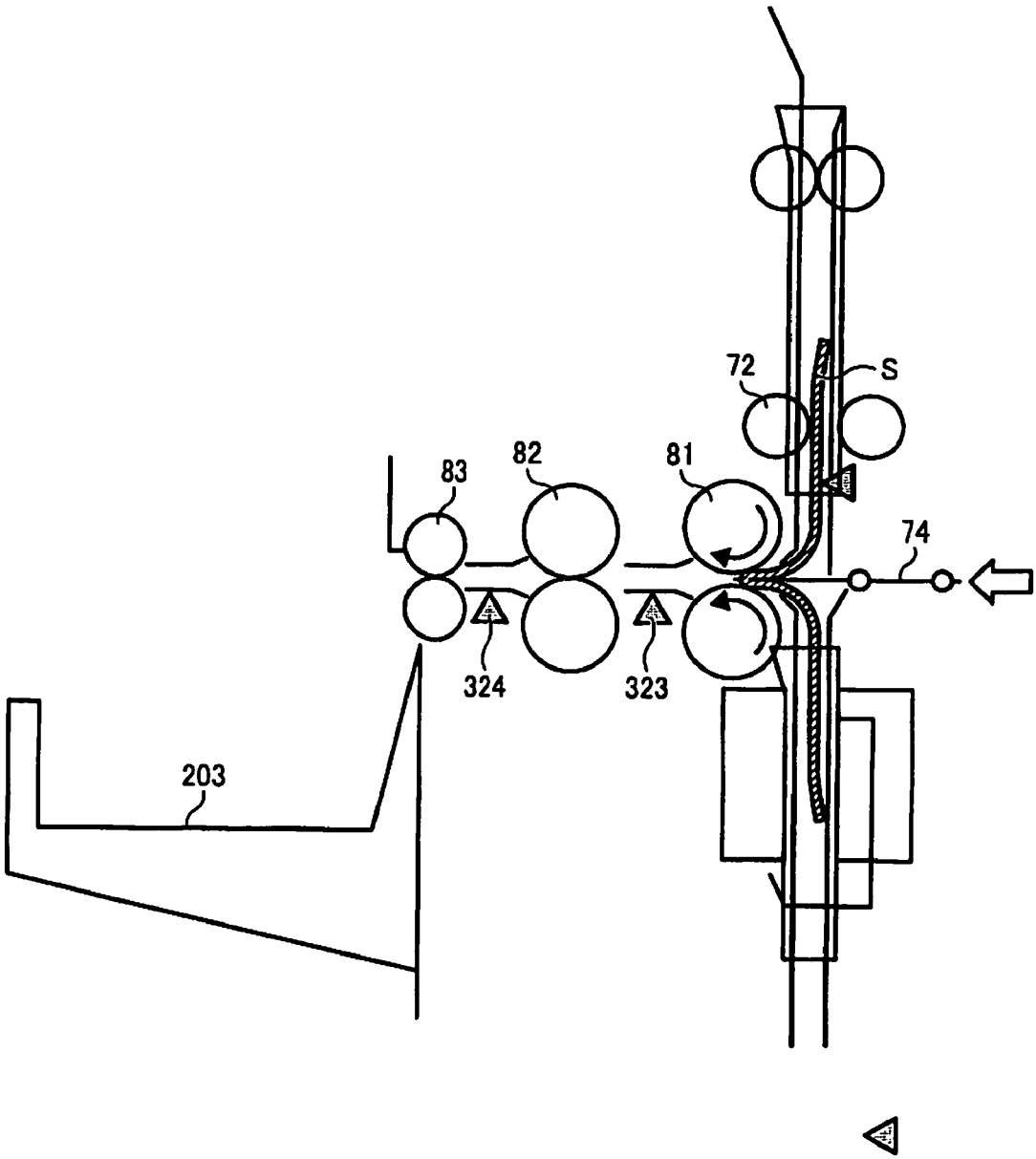

As shown in FIG. 8, while the lower conveyer rollers 72 apart from each other, the movable backend fence 73 lifts the stapled sheet set S up to a position so that the center position, i.e., the stapled position is aligned with the folding plate 74. After that, the folding plate 74 inserts the center position into between the rotating first pressure rollers 81 by pressing the center position in a direction perpendicular to the surface of the sheet set S. The rotating first pressure rollers 81 nip the sheet set S, and convey the sheet set S with a pressure. Thus, a crease is made on the center of the sheet set S.

In this manner, the stapled sheet set S is lifted up to the position for folding without fails only by the movement of the movable backend fence 73.

Figure 10:
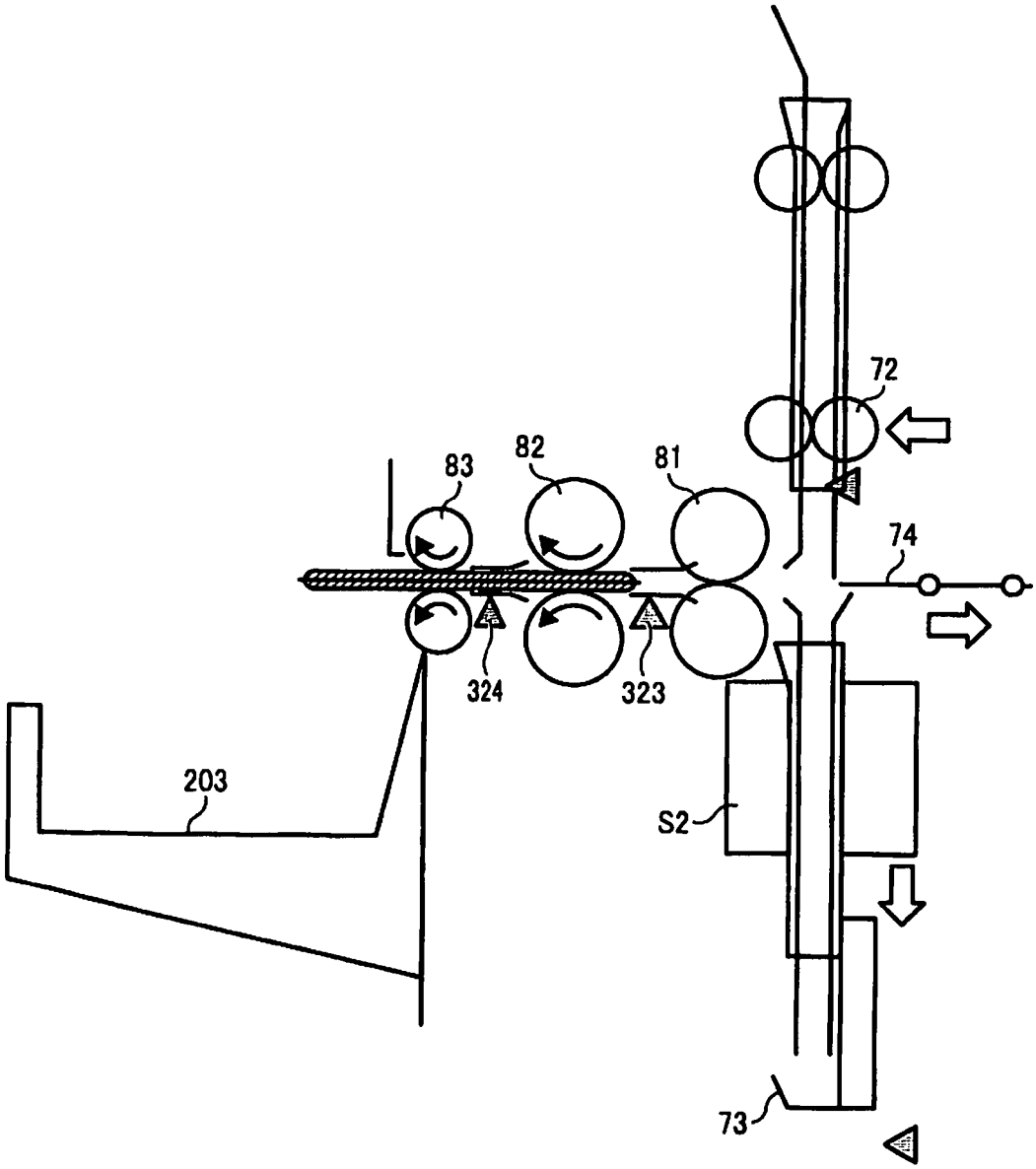

As shown in FIG. 10, the crease of the folded sheet set S is made stronger, re-pressed by a pair of second pressure rollers 82. The re-pressed sheet set S are ejected onto the lower tray 203 via a pair of ejection rollers 83. When it is determined using a sheet sensor 323 that the back end of the sheet set S has been passed through the sheet sensor 323, those members of the saddle-stitch tray G prepare for the next saddle stitch, more particularly, the folding plate 74 and the movable backend fence 73 return to the HPs and the lower conveyer rollers 72 return to a nip position for forming the nip. If a sheet size and number of sheets of the next set of sheets are same as the sheet set S, the movable backend fence 73 may move directly to the position shown in FIG. 2 instead of the HP. Whether the sheet set S is stacked on the lower tray 203 is determined based on the position of the back end of the sheet set S detected using a sheet sensor 324.

Figure 11:
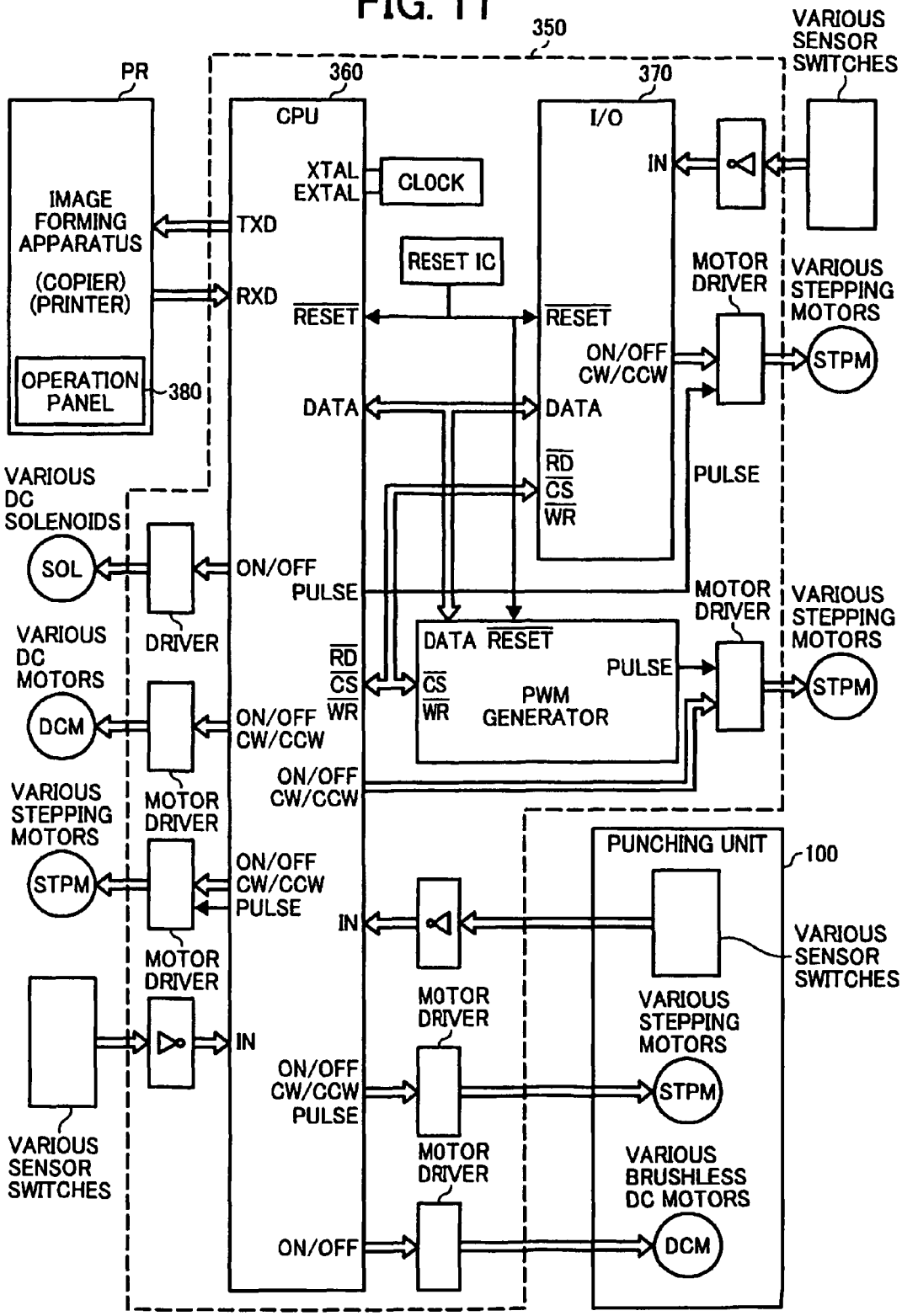
FIG. 11 is a block diagram of the control structure of the system according to the embodiment.

FIG. 11 is a block diagram of the control structure of the system according to the embodiment. The control circuit 350 that controls the sheet finisher PD can be a micro computer, including a central processing unit (CPU) 360 and an input/output interface (I/O interface) 370. The CPU 360 receives via the I/O interface 370 various signals from various switches on an operation panel 380 of the image forming apparatus PR and from various sensors such as the sheet sensor 330. The CPU 360 controls, based on the received signals, various components including the motor that lifts up/down the shift tray 202, the motor that opens/closes the open/close guiding plate, the motor that shifts the shift tray 202, the motor that drives the reverse roller 12, various solenoids including the tapping solenoid, the motors that drive various conveyer rollers, the motors that drive various ejection rollers, the motor that drives the lifting belt 52, the motor that moves the side-stitch stapler S1, the motor that rotates the side-stitch stapler S1 to a slant position, the motor that moves the jogger fences 53, the motor that swings the guiding member 44, the motor that drives the lifting rollers 56, the motor that moves the movable backend fence 73, the motor that moves the folding plate 74, the motor that drives the first pressure rollers 81. The motor that drives the stapled-sheet conveyer rollers 11 sends a pulse signal to the CPU 360. Upon receiving the pulse signal, the CPU 360 counts the received pulse signal and controls a solenoid 170 (not shown) and a jogger motor 158 (not shown) based on a result of count.

The CPU 360 controls those components by reading program codes from a read only memory (ROM)(not shown), loading the program codes on a work area of a random access memory (RAM)(not shown), and executing the loaded program codes.

Figure 12:
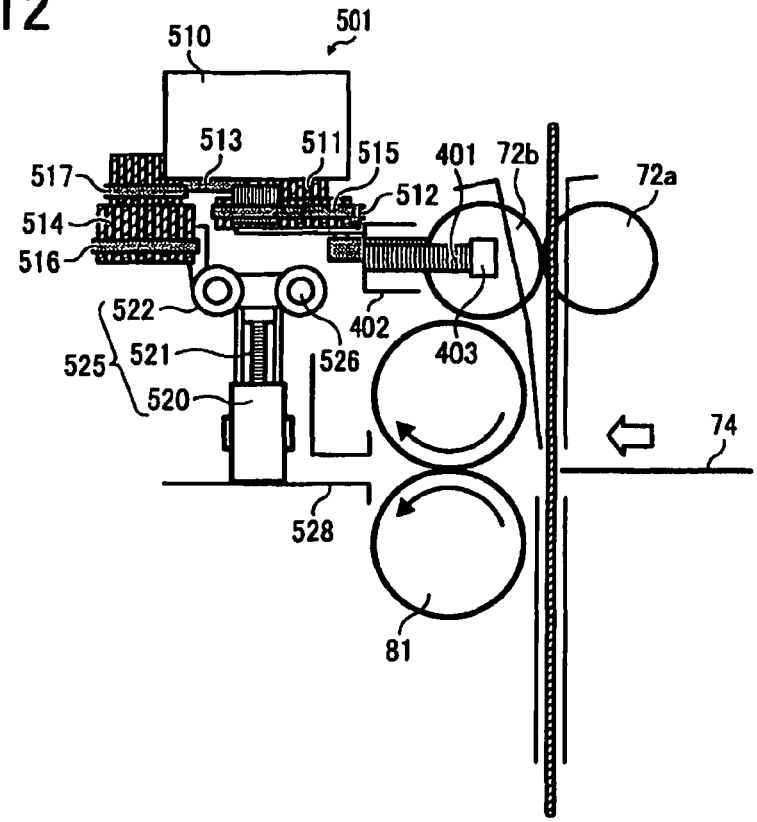
FIGS. 12 to 14 are schematic diagrams for explaining operations of a slidable pressure roller shown in FIG. 1, viewed from the front side of the sheet finisher.
Figure 13:
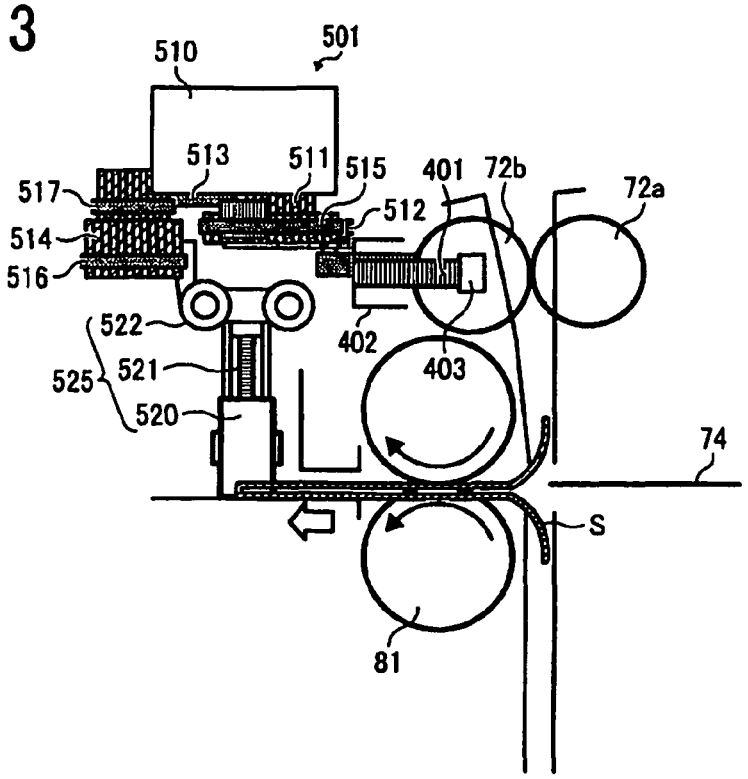
Figure 14:
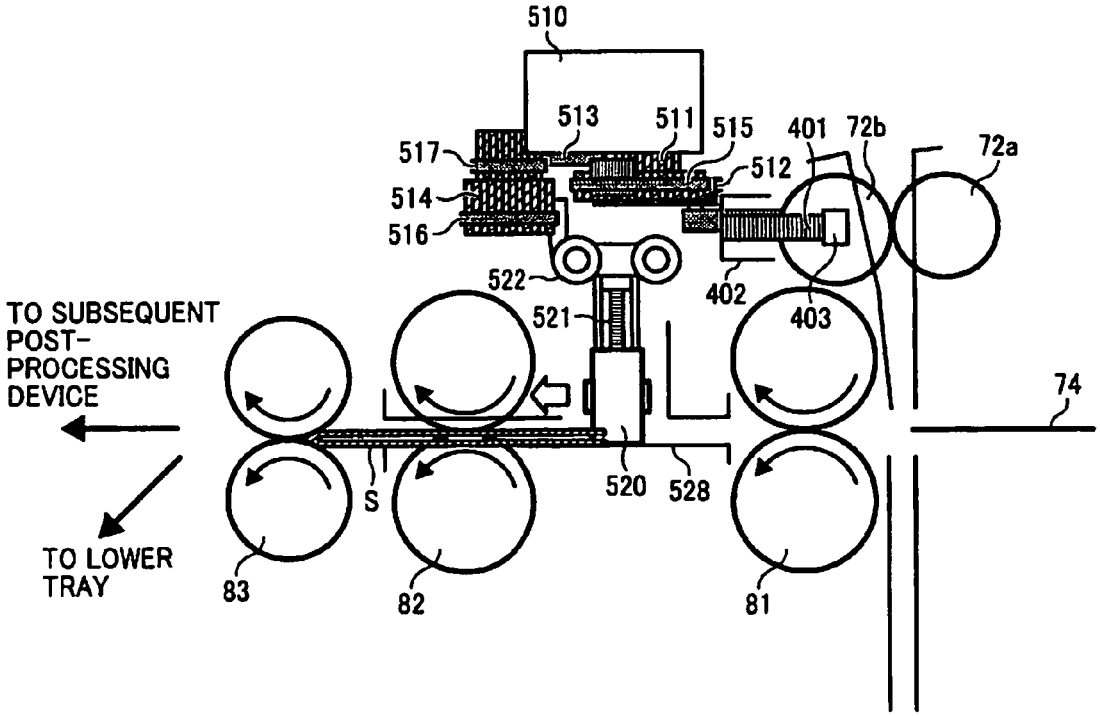

FIGS. 12 to 14 are schematic diagrams for explaining the slide-pressing process. The slidable pressure roller 520 is arranged, as shown in FIG. 1, between the first pressure rollers 81 and the second pressure rollers 82. The slidable pressure roller 520 presses the folded sheet set S, while sliding thereon in the direction perpendicular to the sheet conveying direction in the same manner as the slidable pressure roller disclosed in Japanese Patent Application Laid-open No. 2001-163519, Japanese Patent Application Laid-open No. 2001-206629, and Japanese Patent No. 3566492.

Figure 15:
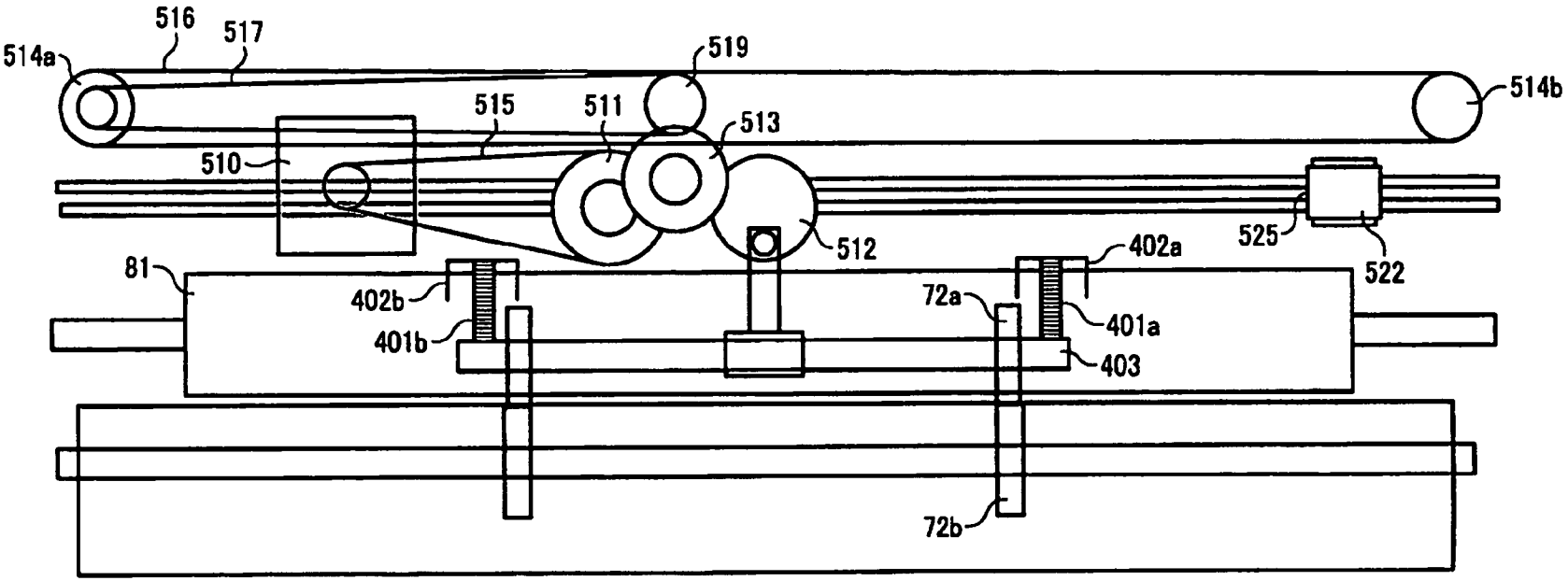
FIG. 15 is a schematic diagram for explaining operations of the slidable pressure roller, viewed from the top side of the sheet finisher.

FIG. 12 is a schematic diagram of a half-folding mechanism at the start of half-folding viewed from the front side of the sheet finisher PD. FIG. 15 is a schematic diagram of the half-folding mechanism shown in FIG. 12 viewed from the top side of the sheet finisher PD. It is assumed that the slidable pressure roller 520 shown in FIG. 12 is at a HP. The operations of the half-folding mechanism including a slide-pressing unit 525 are described below with reference to FIGS. 12 and 15.

The half-folding mechanism includes a half-folding unit including the first pressure rollers 81 and the folding plate 74, the slide-pressing unit 525 including the slidable pressure roller 520, and the second pressure rollers 82. The slide-pressing unit 525 includes the slidable pressure roller 520, a compression spring 521, and a slider 522. The slider 522 is attached to a pair of guiding rods 526, slidable along them. The guiding rods 526 are arranged between a front plate and a back plate parallel to the direction perpendicular to the sheet conveying direction. The slidable pressure roller 520 slides in the rotating manner, while pressing with a predetermined force.

The slide-pressing unit 525 performs the slide-pressing by using the slidable pressure roller 520 sliding on the crease of the sheet set S in the direction perpendicular to the sheet conveying direction. More particularly, the slidable pressure roller 520 is pressed by an elastic force of the compression spring 521, and the slider 522 with the pressed slidable pressure roller 520 slides along the guiding rods 526 on the crease of the sheet set S. Thus, the elastic force of the compression spring 521 makes the crease stronger. The slidable pressure roller 520 presses the sheet set S against a sheet supporting plate 528, which makes it possible to nip the sheet set S with the predetermined pressure.

A driving mechanism 501 arranged over the slide-pressing unit 525 drives the slidable pressure roller 520 and the lower conveyer rollers 72. The driving mechanism 501 includes a pressure-release motor 510, a pressure-release gear 512, a slidable pressure-roller driving gear 519 shown in FIG. 15, and slidable pressure-roller driving pulleys 514. The slidable pressure-roller driving pulleys 514 include a driving pulley 514*a* and a driven pulley 514*b* as shown in FIG. 15. The pressure-release gear 512 moves by rotation of a driving-force transmission belt 515 via a transmission gear 513. The driving-force transmission belt 515 rotates between a pulley that is attached to a rotation shaft of the pressure-release motor 510 and a driving-force transmission gear 511. The transmission gear 513 is merged with the slidable pressure-roller driving gear 519 (see FIG. 15). With this configuration, both the pressure-release gear 512 and the slidable pressure-roller driving gear 519 rotate by the driving of the pressure-release motor 510.

As shown in FIG. 12, a lever 527 (not shown) is arranged near a circumference of a bottom surface of the pressure-release gear 512. The lever 527 is rotatably attached to a center of a driven shaft 403 of one of the lower conveyer rollers 72 that is closer to the first pressure rollers 81 (hereinafter, "lower conveyer roller 72*b*"). With this configuration, the driven shaft 403 moves linearly close to or apart from the other lower conveyer roller 72 (hereinafter, "lower conveyer roller 72*a*") by rotation of the pressure-release gear 512, which makes it possible to nip and release the sheet set S. To move the lower conveyer roller 72*b* to/from the lower conveyer roller 72*a* and convey the sheet set S that is nipped by the lower conveyer rollers 72*a* and 72*b*, an end of a compression spring 401 is fixed to a fixing plate 402, and the other end presses with an elastic force the driven shaft 403 of the lower conveyer roller 72*b* to the lower conveyer roller 72*a*. Two compression springs 401*a* and 401*b* and two fixing plates 402*a* and 402*b* are shown in FIG. 15. It is allowable to press both ends of the driven shaft 403 by the compression springs 401*a* and 401*b* as shown in FIG. 15.

As shown in FIG. 15, a slidable pressure-roller driving belt 517 rotates between the slidable pressure-roller driving gear 519 and the driving pulley 514*a*. The slidable pressure-roller driving belt 517 transmits the driving force of the pressure-release motor 510 to the driving pulley 514*a*. A slidable pressure-roller sliding belt 516 rotates between the driving pulley 514*a* and the driven pulley 514*b*. The slider 522 that supports the slidable pressure roller 520 is attached to the slidable pressure-roller sliding belt 516. In other words, the relative positions of the driving pulley 514*a* and the driven pulley 514*b* are decided so that the slidable pressure-roller sliding belt 516 runs in parallel to the guiding rods 526.

With this configuration of the half-folding mechanism, the lower conveyer roller 72*b* moves close to or apart from the lower conveyer roller 72*a*. When the sheet set S is to be conveyed through the saddle-stitch tray G, the nipped sheet set S is released. The slidable pressure roller 520 presses the sheet set S while sliding in the direction perpendicular to the sheet conveying direction. In other words, the lower conveyer roller 72*b* moves, as described above with reference to FIGS. 7 and 8, apart from the lower conveyer roller 72*a* between the situations shown in FIG. 12 and FIG. 13. After the sheet set S is released from the lower conveyer rollers 72*a* and 72*b*, the sheet set S is half-folded with the folding plate 74 and the first pressure rollers 81.

In this manner, the lower conveyer roller 72*b* and the slidable pressure roller 520 receive the driving force of the pressure-release motor 510 via the driving-force transmission belt 515 and the driving-force transmission gear 511, and move by the received driving force. The received driving force is transmitted to the pressure-release gear 512 and the slidable pressure-roller driving gear 519 via the transmission gear 513. The driving force is further transmitted to the slidable pressure-roller driving pulleys 514 via the slidable pressure-roller driving belt 517, and thus the slidable pressure-roller sliding belt 516 rotates. As a result, the slidable pressure roller 520 is driven by the rotation of the slidable pressure-roller sliding belt 516.

When the slidable pressure roller 520 is at the HP, the lower conveyer roller 72*b* is apart from the lower conveyer roller 72*a*. This configuration is effective to prevent a sheet jam, because the slidable pressure roller 520 keeps out of an area in which the sheet set S is to be conveyed while the first pressure rollers 81 presses the sheet set S.

FIG. 12 is a schematic diagram of the half-folding mechanism when the sheet set S is conveyed downward in the saddle-stitch tray G; FIG. 13 is a schematic diagram of the half-folding mechanism when the slidable pressure roller 520 presses the folded sheet set S after the sheet set S is half-folded by the folding plate 74 and the first pressure rollers 81; and FIG. 14 is a schematic diagram of the half-folding mechanism when the sheet set S is re-pressed by the second pressure rollers 82. The sheet set S is then ejected out as the processed copy set or conveyed to a subsequent post-processing device such as a cutting device.

Figure 16A:
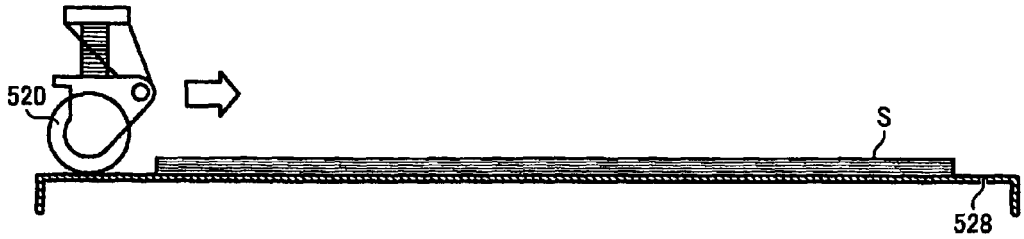
FIGS. 16A to 16C are schematic diagrams of the slidable pressure roller sliding on a half-folded sheet set.
Figure 16B:
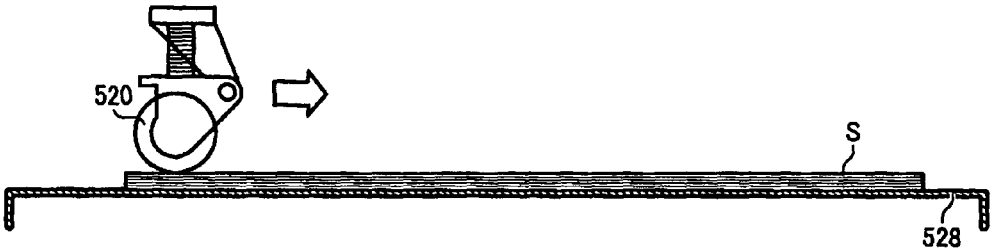
Figure 16C:
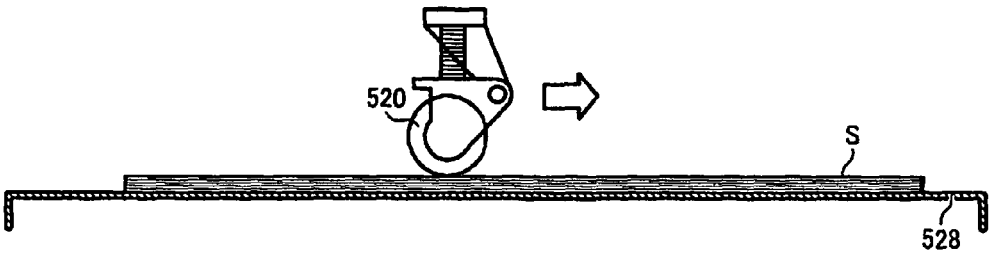

After the crease is made on the center of the sheet set S by the first pressure rollers 81, the sheet set S is conveyed with the folded side being ahead and is stopped when the folded side is on a line along which the slidable pressure roller 520 slides. The slidable pressure roller 520 slides on the folded side in the direction to the sheet conveying direction as shown in FIGS. 16A to 16C. The slidable pressure roller 520 slides by the driving force of the pressure-release motor 510 in the half-folding mechanism.

If the number of sheets of the sheet set S is small, a thickness of the folded side of the sheet set S decreases enough after the slide-pressing by the slidable pressure roller 520;

As shown in FIGS. 16A to 16C, the sheet set S is conveyed on an upper surface of the sheet supporting plate 528. The slidable pressure roller 520 presses the sheet set S against the sheet supporting plate 528, which makes it possible to surely apply the pressing force to the crease of the sheet set S. FIGS. 16A to 16C are schematic diagram of the slidable pressure roller 520 and the sheet set S for explaining the position of the slidable pressure roller 520. In the start of the slide-pressing, the slidable pressure roller 520 as shown in FIG. 16A is at the HP; immediately after the start of the slide-pressing, the slidable pressure roller 520 as shown in FIG. 16B is on an end of the folded side; and during the slide-pressing, the slidable pressure roller 520 as shown in FIG. 16C is sliding on the folded side.

If the number of sheets of the sheet set S is large or each sheet is thick, one slide is not enough to decrease the thickness of the folded side to a desired level and to fold the sheet set S accurately. If the slidable pressure roller 520 slides on the entire folded side in the sheet-width direction several times, the thickness of the folded side decreases to the desired level and the sheet set S is folded accurately. However, it takes a longer time, which results in decreasing of productivity by the amount of the increased time.

In the present embodiment, the folded side parallel to in the direction perpendicular to the sheet conveying direction is divided into three sections X1, X2, and X3, and the number of slides at which the slidable pressure roller 520 slides on each of the sections X1, X2, and X3 is decided independently. With this configuration, the slidable pressure roller 520 can slide on each section at only required times, which decreases the slide-pressing time.

Figure 17A:
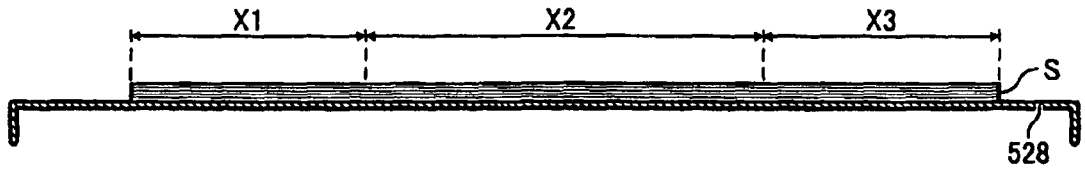
FIGS. 17A and 17B are schematic diagrams for explaining positions of sections with respect to the half-folded sheet set.
Figure 17B:
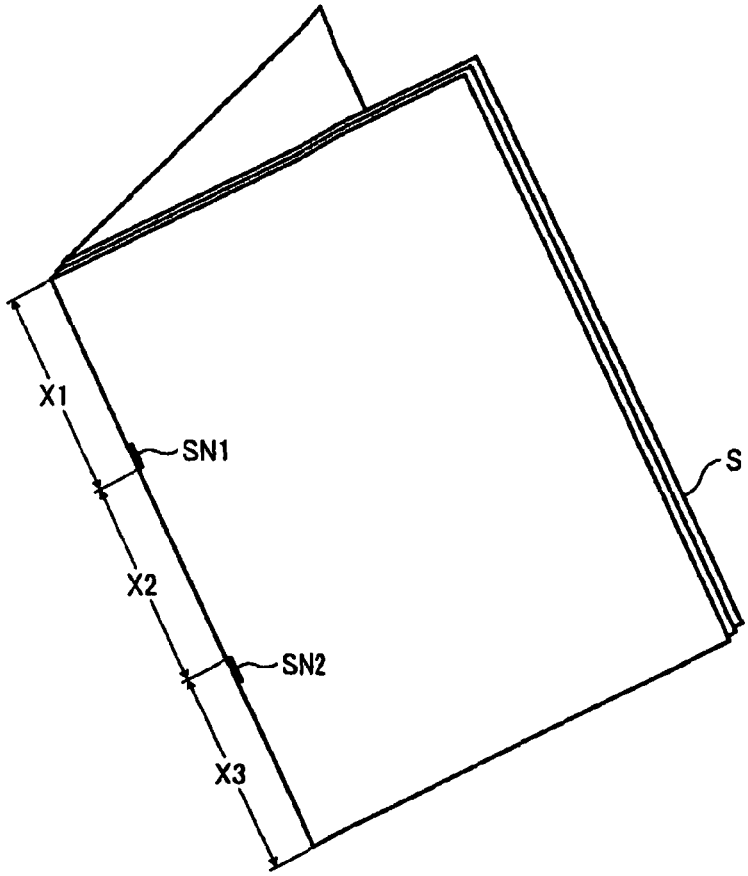

FIGS. 17A and 17B are schematic diagrams for explaining positions of the sections X1, X2, and X3 with respect to the half-folded sheet set S. FIG. 17A is a schematic diagram of the sheet set S viewed from the direction perpendicular to the sheet conveying direction; and FIG. 17B is a perspective view of the sheet set S. Although three sections are shown in FIGS. 17A and 17B, the number of sections is not limited to three.

The folded side of the sheet set S is divided into the sections X1, X2, and X3 in this order with respect to the direction perpendicular to the sheet conveying direction, with the section X1 being closest to one end of the folded side. If a length of the section X1 is equal to that of the section X3, a gap between thicknesses of both ends of the sheet set S is suppressed. If the length of the sections X1 and X3 is shorter than that of the section X2, the decrease in productivity is suppressed. In other words, it is preferable that the length of the sections X1 and X3 is equal (i.e., $X1=X3$) and the length of the section X1 is smaller than that of the section X2 (i.e., $X1 \leqq X2$). The length of the sections X1 and X3 is, more preferably, one quarter of the entire length or larger (i.e., $X1 \geqq L/4$, where $L=X1+X2+X3$). Still preferably, the length of the section X1 is between the quarter to one third of the entire length (i.e., $L/3 \geqq X1 \geqq L/4$), although this preferable range is regardless of a staple position.

It has been known that an area near a staple is likely to be thick. Therefore, it is preferable to the sections where the slidable pressure roller 520 slides more times include staple positions SN1 and SN2.

Figure 20A:
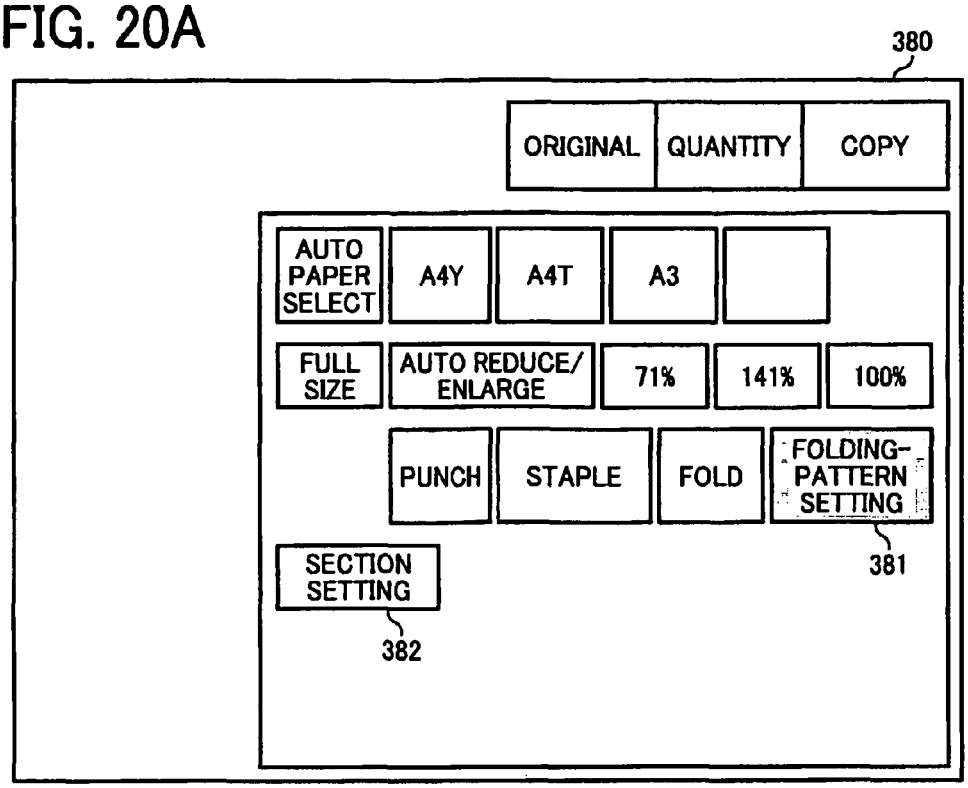
FIGS. 20A and 20B are schematic diagrams of setting screens for selecting a desired sliding pattern according to the embodiment.
Figure 20B:
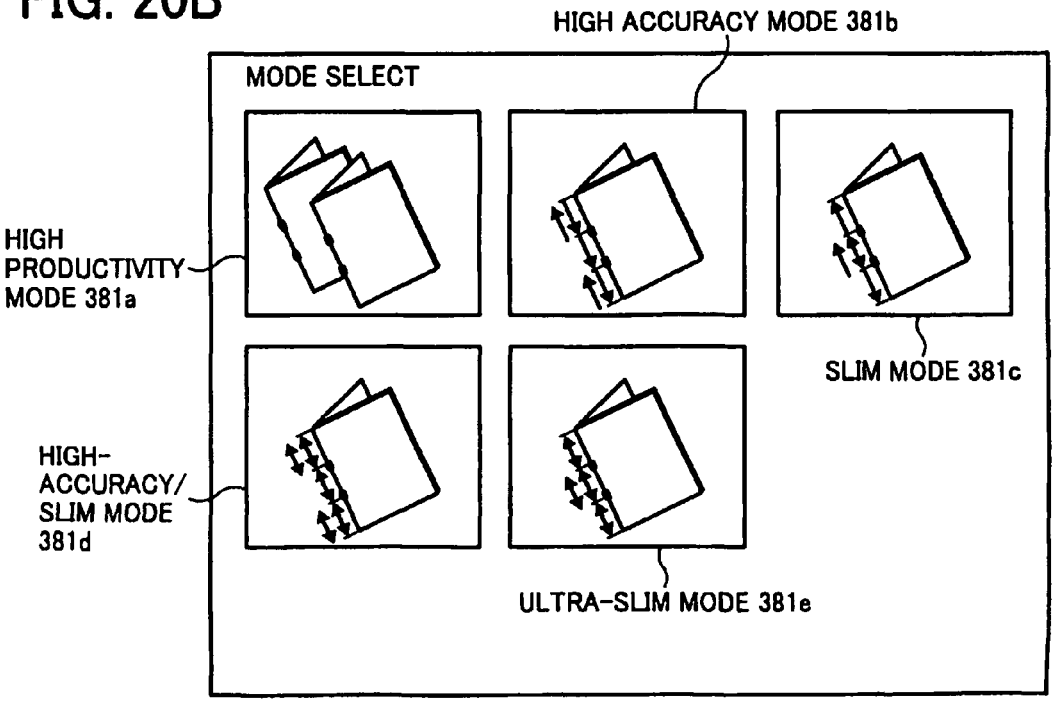

An operator (user) can set the length of each of the sections X1, X2, and X3 with the operation panel 380 shown in FIGS. 20A and 20B. More particularly, when the operator selects a section setting key 382 on the operation panel 380, a diameter setting screen (not shown) is displayed. The operator can set the number of sections and the length of each section with the diameter setting screen. It is assumed that the operator sets the number of sections to three. After that, the operator sets the length of the section X1 by entering a desired length or a rate of the section length against the entire length. The length of the section X3 is automatically set to the same length of the section X1. The length of the section X2 is calculated by subtracting the lengths of the sections X1 and X3 from the entire length.

The operator can set the number of slides (number of switchbacks) at each section in addition to the number of sections and the length of each section. The number of slides affects the pattern of sliding by the slidable pressure roller 520.

After the half-folding, the sheet set S is either ejected onto the lower tray 203 as the processed copy set or conveyed to the subsequent post-processing device such as the cutting device as described with reference to FIG. 14. If the sheet set S is to be conveyed to the cutting device, the sheet set S will be pressed in the cutting device and thereby the thickness of the folded side will decrease. Taking the decrease in the thickness at the cutting device into consideration, the number of slides on the sections X1 and X3 is increased to flatten the both ends of the half-folded sheet set S as shown in a pattern (2) of FIG. 18B. If the both ends of the half-folded sheet set S is flattened, accuracy in the cutting increases. FIGS. 18A to 18E are schematic diagrams for explaining sliding patterns of the slidable pressure roller 520. The sheet set S is divided into the sections X1, X2, and X3 with positions Z1, Z2, Z3, and Z4 in this order, with the position Z1 being closest to the HP. In the pattern (2), the slidable pressure roller 520 slides back and forth once between the positions Z1 and Z2. The slidable pressure roller 520 then slides from the position Z1 to the position Z4 that is beyond the position Z3, returns to the position Z3, and once more slides to the position Z4. The number of slides on the sections X1 and X3 is three in the pattern (2). To flatten the areas near the staple positions SN1 and SN2, the sections X1 and X3 include the staple positions SN1 and SN2, respectively.

Figure 21:
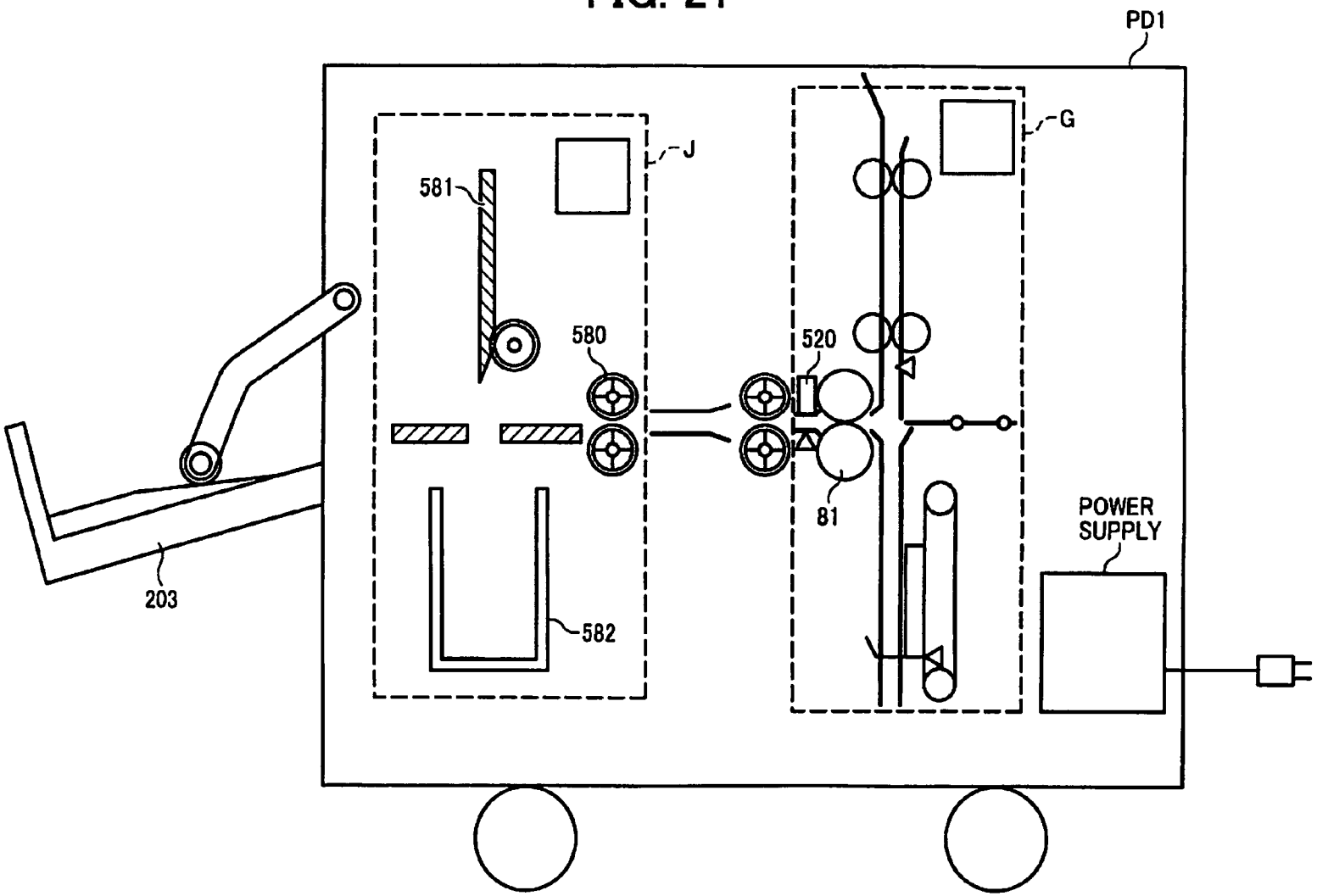
FIG. 21 is a schematic diagram of a sheet finisher including the saddle-stitch tray and a cutting device according to the embodiment.
Figure 22A:
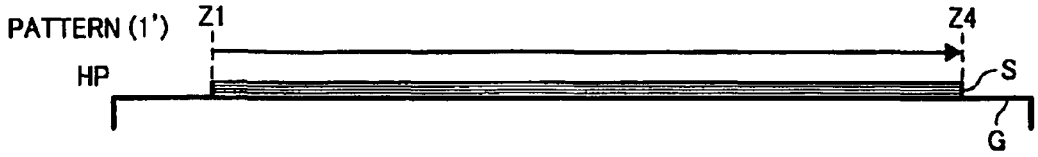
FIGS. 22A to 22E are schematic diagrams for explaining sliding patterns with variable sliding speeds according to the embodiment.
Figure 22B:
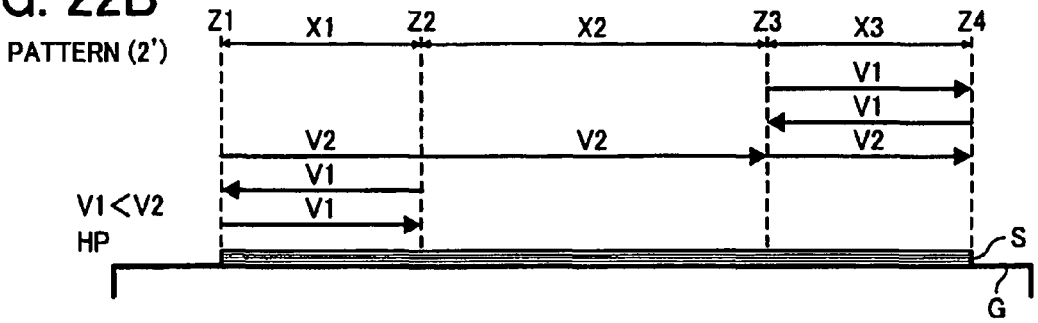
Figure 22C:
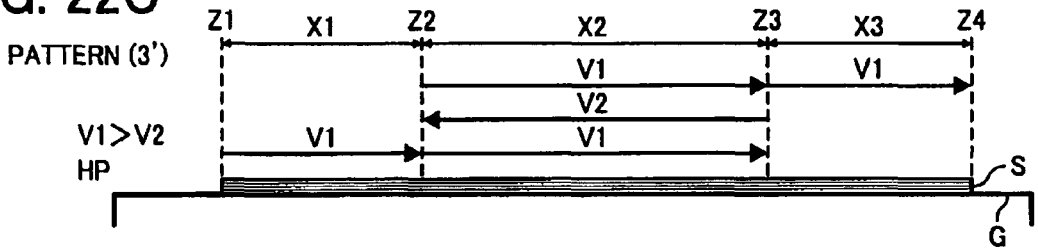
Figure 22D:
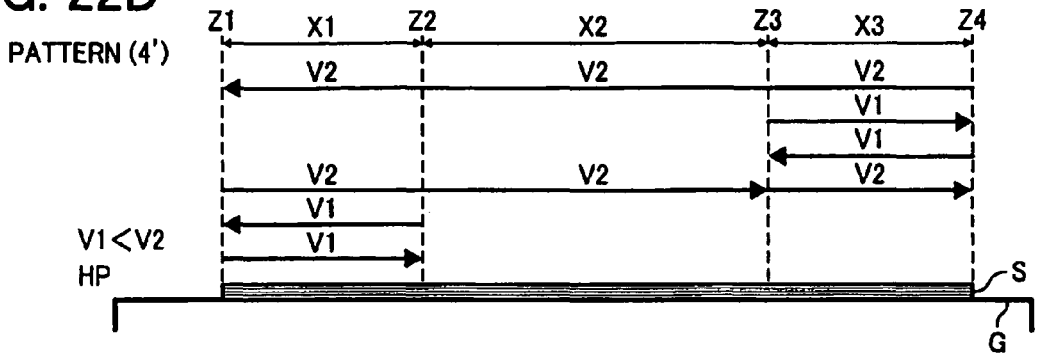
Figure 22E:
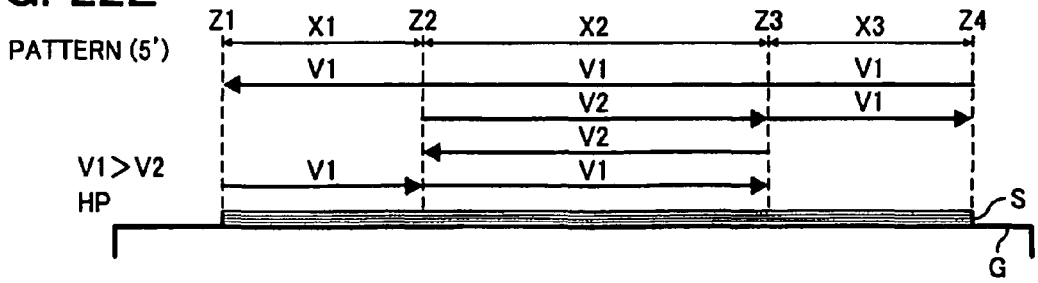

FIG. 21 is a schematic diagram of a sheet finisher PD1 including the saddle-stitch tray G and a cutting device J. The cutting device J is arranged upstream of the saddle-stitch tray G. In the sheet finisher PD1, the half-folded sheet set S is conveyed from the saddle-stitch tray G to the cutting device J. In the cutting device J, the sheet set S is conveyed toward a cutter 581 by a pair of conveyer rollers 580, and the sheet set S is stopped at a cutting position. The cutter 581 moves down and cuts the sheet set S at the cutting position. Cut wastes are collected into a hopper 582. When the hopper 582 is filled with cut wastes, the user removes the cut wastes from the hopper 582. In the sheet finisher PD1, the saddle-stitch tray G works as a sheet conveyer device that conveys the sheet set S to the cutting device J. Although the cutting device J is shown as a component of the sheet finisher PD1, the cutting device J and the sheet finisher PD1 can be prepared as separate devices.

Figure 18A:
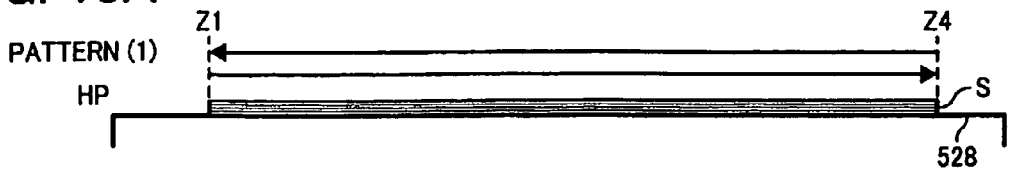
FIGS. 18A to 18E are schematic diagrams for explaining sliding patterns according to the embodiment.
Figure 18B:
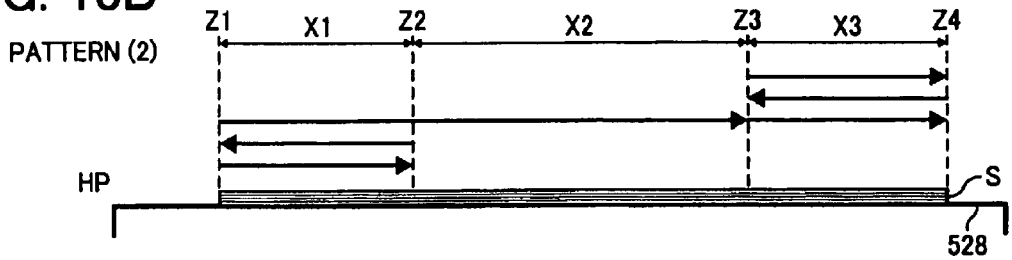
Figure 18C:
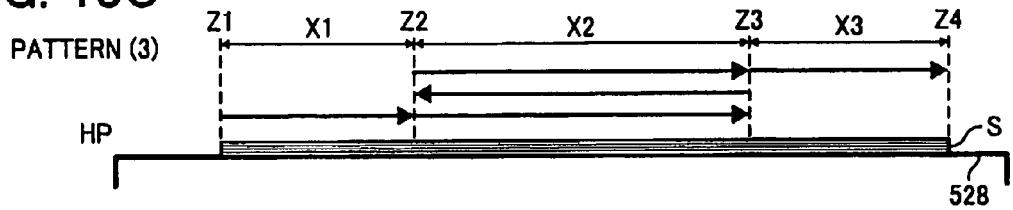

When the half-folded sheet set S is ejected out as the processed copy set, the number of slides on the section X2 is increased to decrease the thickness of the folded side as shown in a pattern (3) of FIG. 18C. In the pattern (3), the slidable pressure roller 520 shifts from the position Z1 to the position Z3, and returns to the position Z2. The slidable pressure roller 520 then slides from the position Z2 to the position Z4. In other words, the number of slides on the sections X1 and X3 is one, and the number of slides on the section X2 is three.

The operator selects the desired sliding pattern taking various conditions into consideration, for example, stapling, number of sheets, thickness of each sheet, size of sheet, and presence of the subsequent post-processing device, thereby independently setting the number of slides on each section to a required value. The operator sets those settings with the operation panel 380 shown in FIGS. 20A and 20B, and the CPU 360 controls the related units based on the specified settings.

Figure 18D:
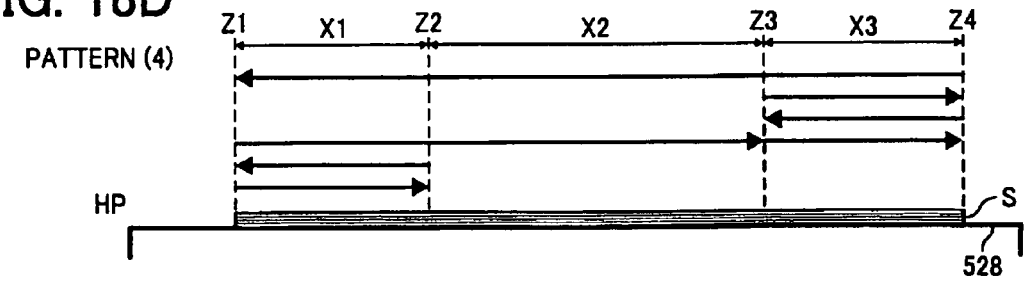
Figure 18E:
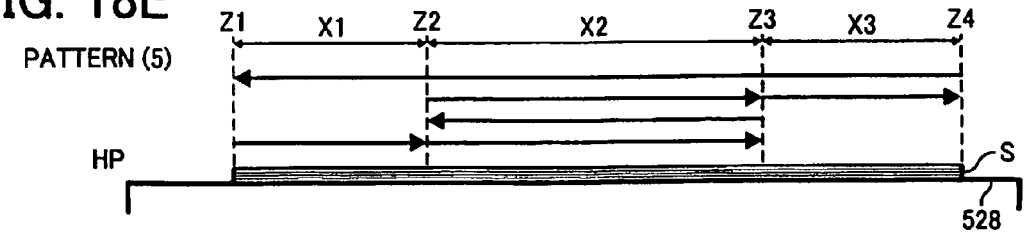
Figure 19:
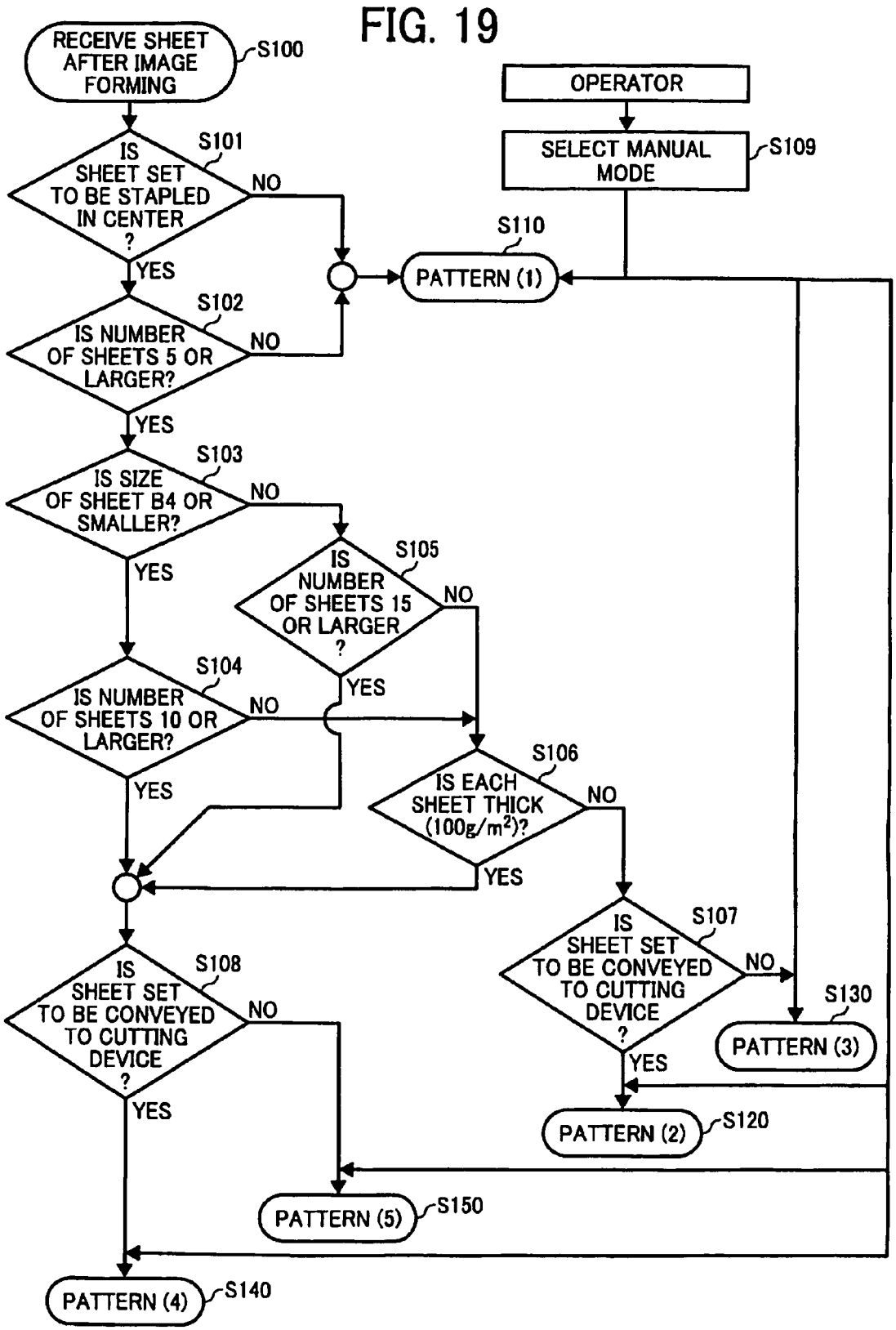
FIG. 19 is a flowchart of a sliding-pattern selecting process according to the embodiment.

FIG. 19 is a flowchart of a sliding-pattern selecting process of selecting an appropriate one out of the sliding patterns shown in FIGS. 18A to 18E that is to be performed by the slidable pressure roller 520 in the slide-pressing process.

The sheet after image forming is conveyed from the image forming apparatus PR to the side-stitch tray F of the sheet finisher PD, and is aligned with other sheets as the sheet set S. The saddle-stitch tray G receives the sheet set S (Step S100). It is determined whether the sheet set S is to be stapled in the center (Step S101). When the sheet set S is to be stapled in the center (Yes at Step S101), it is determined whether the number of sheets is equal to or larger than a first threshold (Step S102). The first threshold is assumed to be five. When the sheet set S is not to be stapled (No at Step S101) or when the number of sheets is smaller than the first threshold (No at Step S102), the pattern (1) shown in FIG. 18A is selected (Step S110). If, for example, the sheet set S has five or larger sheets and is to be just folded without stapled, the pattern (1) is selected. In the pattern (1), the number of slides on all sections is equal, more particularly, two. The slidable pressure roller 520 slides back and forth between the positions Z1 and Z4 once. The pattern (1) is called normal pattern.

When the number of sheets is equal to or larger than the first threshold (Yes at Step S102), it is determined whether the size of sheet is equal to or smaller than a predetermined size, for example, B4 (Step S103). It has been known that if the size of sheet is small, a week crease is likely to be made on the sheet set S and the thickness of the folded side increases. It means that if two sets having the same number of sheets but different in size are folded in the same pattern, the thickness of the folded side of the large-size set is lower than that of the small-size set. Therefore, the process control branches based on a result of determination whether the size of sheet is equal to or smaller than the predetermined size, i.e., B4.

When the size of sheet is larger than B4 (No at Step S103), it is determined whether the number of sheets is equal to or larger than a second threshold (Step S105). The second threshold is assumed to be 15. When the number of sheets is smaller than the second threshold (No at Step S105), it is determined whether each sheet is thick (Step S106). It is assumed that weight per area is equal to or heavier than 100 $g/m^2$, each sheet is determined to be thick.

When each sheet is not thick (No at Step S106), it is determined whether the sheet set S is to be conveyed to the subsequent post-processing device, for example, the cutting device (step S107). When the sheet set S is to be conveyed to the cutting device (Yes at Step S107), the slide-pressing process in the pattern (2) shown in FIG. 18B is performed (Step S120). When the sheet set S is not to be conveyed to the cutting device (No at Step S107), the pattern (3) shown in FIG. 18C is selected (Step S130).

When the size of sheet is equal to or smaller than B4 (Yes at Step S103), it is determined whether the number of sheets is equal to or larger than a third threshold (Step S104). The third threshold is assumed to be 10. When the number of sheets is equal to or larger than the third threshold (Yes at Step S104), when the number of sheets is equal to or larger than the second threshold (Yes at Step S105), or when each sheet is thick (Yes at Step S106), it is determined whether the sheet set S is to be conveyed to the cutting device (step S108). When the sheet set S is to be conveyed to the cutting device (Yes at step S108), a pattern (4) shown in FIG. 18D is selected (Step S140). In the pattern (4), after the slidable pressure roller 520 slides to the position Z4 in the same manner as the pattern (2), the slidable pressure roller 520 returns to the position Z1. As a result, the number of slides on each section is increased by one compared with the pattern (2). In other words, if two slides are added to the number of slides on the sections X1 and X3 in the normal pattern to flatten the sections X1 and X3, the pattern (3) is implemented.

When the sheet set S is not to be conveyed to the cutting device (No at step S108), a pattern (5) shown in FIG. 18E is selected (Step S150).

In the pattern (5), after the slidable pressure roller 520 slides to the position Z4 in the same manner as the pattern (3), the slidable pressure roller 520 returns to the position Z1. As a result, the number of slides on each section is increased by one compared with the pattern (3). In other words, if two slides are added to the number of slides on the section X2 in the normal pattern to decrease the thickness of the folded side, the pattern (5) is implemented.

Instead of automatically selecting the appropriate pattern, the operator can manually select the desired pattern with the operation panel 380. When a manual mode is selected (Step S109), the pattern specified by the operator is selected even when the sheet set S does not satisfy the conditions for the specified pattern.

FIGS. 20A and 20B are schematic diagrams of examples of setting screens displayed on the operation panel 380. When a folding-pattern setting key 381 shown in FIG. 20A is pressed, a mode selecting screen shown in FIG. 20B is displayed. The operator selects a desired one from among various modes on the mode selecting screen, such as a high productivity mode 381*a*, a high accuracy mode 381*b*, a slim mode 381*c*, a high-accuracy/slim mode 381*d*, and an ultra-slim mode 381*e*. In the embodiment, the high productivity mode 381*a* is corresponding to the pattern (1), the high accuracy mode 381*b* is the pattern (2), the slim mode 381*c* is the pattern (3), the high-accuracy/slim mode 381*d* is the pattern (4), and the ultra-slim mode 381*e* is the pattern (5). When the operator selects the desired mode, the slide-pressing in the corresponding pattern is performed.

Although various patterns are made by changing the number of slides on each section as shown in FIGS. 18A to 18E, it is possible to make patterns by changing the sliding speed at each section instead of or in addition to changing the number of slides. Patterns (1') to (5') shown in FIGS. 22A to 22E are examples of such patterns. Although the routes in the patterns (1') to (5') are same as the routes in the patterns (1) to (5), respectively, the sliding speed on each section is not constant in the patterns (1') to (5').

In the patterns (2') and (4'), to flatten the both ends, the number of slides on the sections X1 and X3 is increased and the sliding speed at the sections X1 and X3 is a low speed V1 while the sliding speed at the section X2 is a high speed V2.

On the other hand, in the patterns (3') and (5'), to flatten the center, the number of slides on the section X2 is increased and the sliding speed at the section X2 is the low speed V1 while the sliding speed at the sections X1 and X3 is the high speed V2.

In this manner, the slidable pressure roller 520 slides on a priority section at the low speed while sliding on the other sections at the high speed as shown in the patterns (1') to (5'), which makes it possible to make the crease strong enough with the short slide-pressing time.

Figure 23:
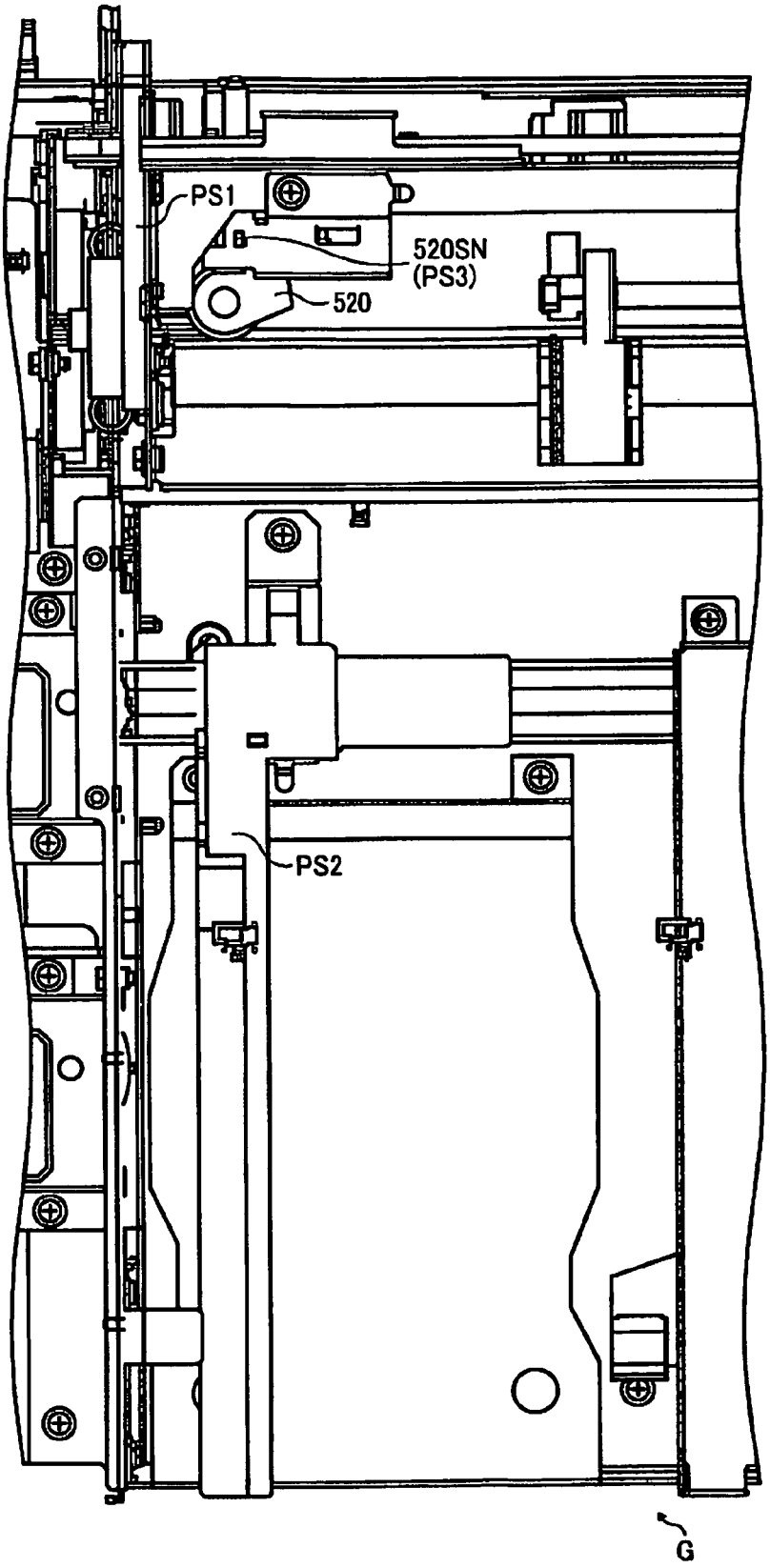
FIG. 23 is a side view of the saddle-stitch tray for explaining a reference position based on which the sections are defined.

Although the sheet is divided into the sections with separation positions that are measured from the end of the sheet as the reference position in the embodiment, it is possible to use another position as the reference position instead of the end of the sheet. FIG. 23 is a side view of relevant parts of the saddle-stitch tray G. The reference position can be, for example, a side-plate position PS1, a waiting position PS2 at which the saddle-stitch jogger fence is positioned in the start of the half-folding, or an alignment position of the saddle-stitch jogger fence. Alternatively, it is allowable to provide a detection sensor 520SN that detects a position of the slidable pressure roller 520 and set a position of the detection sensor 520SN to the reference position.

The number of sheets, the thickness of each sheet, the size of sheet, and the type of subsequent post-processing device that are used in the explanation are examples. Those values or types are variable depending on the hardware structure, the applications, or the like.

According to the embodiment, the folded sheet set is unevenly pressed by the slidable pressure roller sliding in the direction perpendicular to the sheet conveying direction by dividing the entire length into a plurality sections and setting the number of slides on each section independently. This makes it possible to reduce the slide-pressing time and suppress decrease in productivity.

Moreover, it is possible to produce the appropriately folded sheet-set by switching sliding patterns of the slidable pressure roller without making the system complicated.

Furthermore, it is possible to reduce the thickness of the folded sheet-set while suppressing decrease in productivity.

Moreover, it is possible to flatten the both ends of the folded sheet-set while suppressing decrease in productivity, which increases accuracy at the subsequent post-processing step.

Furthermore, it is possible to flatten the folded side with respect to the direction perpendicular to the sheet conveying direction.

Moreover, it is possible to independently adjust each section of the folded side as appropriately and perform proper processing.

Furthermore, it is possible to convey to the subsequent post-processing device the sheet set that is properly processed based on a type of the subsequent post-processing device.

According to an aspect of the present invention, a slidable pressure member presses a folded sheet-set while unevenly sliding on a folded side by dividing the folded side into a plurality of sections with separation positions measured from an end of the folded side and setting the number of slides on each section independently. This reduces a thickness of the folded side, while suppressing decrease in productivity.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An apparatus for folding a sheet, the apparatus comprising:

a folding unit that folds the sheet along a folding line thereby obtaining a folded sheet having a folded side;

a pressing unit that presses the folded side of the folded sheet;

a driving unit that causes the pressing unit to slide in a direction substantially perpendicular to a conveying direction of the sheet; and a control unit that sets a number of slides at which the pressing unit is to slide on each of a plurality of sections of the folded side depending on a distance of each of the sections from a reference position, the number of slides at which the pressing unit slides on each of the respective plurality of section is decided independently thereof, and sets a length of each of the sections and controls the driving unit so as to slide in each of the sections for the number of slides set for the respective section.

2. The apparatus according to claim 1, wherein the folding unit includes a pair of rollers that nip the sheet thereby making a crease on the sheet; and a plate that pushes the sheet between the rollers, and the pressing unit includes a sheet supporting member that supports the folded sheet by supporting a first surface of the folded sheet; and a slidable roller that slides on a second surface of the folded sheet along the crease.

3. The apparatus according to claim 1, wherein number of the sections is three or larger.

4. The apparatus according to claim 3, wherein the sections includes a first section that includes a first end of the folded side, a second section, and a third section that includes a second end of the folded side, wherein the second section is positioned between the first section and the third section, and the control unit sets the number of slides on each of the first section and the third section to a value at least one of a larger value and a smaller value than the number of slides on the second section.

5. The apparatus according to claim 4, wherein length of each of the first section and the third section is equal to or shorter than length of the second section.

6. The apparatus according to claim 3, wherein sliding speed at which the pressing unit slides on each of the sections is set independently.

7. The apparatus according to claim 1, wherein the reference position is any one of an end of the sheet, a position of a side plate of the apparatus, a waiting position at which a saddle-stitch jogger fence is positioned in a start of folding, an alignment position of the saddle-stitch jogger fence, and a position of a detection sensor that detects a position of the pressing unit.

8. The apparatus according to claim 5, further comprising an operation unit that receives an instruction about the length of each of the sections from an operator.

9. The apparatus according to claim 4, wherein the sheet includes a plurality of sheets and the control unit sets the number of slides based on any one of number of sheets, thickness of each sheet, and total thickness of the sheets, and dimensions of the sheets.

10. The apparatus according to claim 4, wherein a plurality of different patterns are made by combining the number of slides on each of the sections, and the control unit determines whether the sheet is to be conveyed to a subsequent post-processing device connected to the apparatus, and selects a pattern from the patterns based on a result of determination.

11. The apparatus according to claim 3, further comprising a staple unit that temporarily accommodates the folded sheets, aligns the folded sheets, and staples the folded sheets, wherein a separation position of sections at extreme ends are staple positions at which the sheet is to be stapled by the staple unit.

12. The apparatus according to claim 7, further comprising a staple unit that temporarily accommodates the folded sheets, aligns the folded sheets, and staples the folded sheets, wherein a separation position of sections at extreme ends are staple positions at which the folded sheet is to be stapled by the staple unit.

13. The apparatus according to claim 3, further comprising a staple unit that temporarily accommodates the folded sheets, aligns the folded sheets, and staples the folded sheets, wherein the control unit determines whether the sheet is to be stapled with the staple unit, and sets the number of slides based on a result of determination.

14. The apparatus according to claim 7, further comprising a staple unit that temporarily accommodates the folded sheets, aligns the folded sheets, and staples the folded sheets, wherein the control unit determines whether the folded sheet is to be stapled with the staple unit, and sets the number of slides based on a result of determination.

15. The apparatus according to claim 3, wherein a plurality of different patterns are made by combining the number of slides on each of the sections, the apparatus further comprising an operation unit that receives an instruction for specifying a desired pattern out of the patterns from an operator.

16. An image forming apparatus that comprises an apparatus for folding a sheet, the apparatus including:

a folding unit that folds the sheet along a folding line thereby obtaining a folded sheet having a folded side;

a pressing unit that presses the folded side of the folded sheet;

a driving unit that causes the pressing unit to slide in a direction substantially perpendicular to a conveying direction of the sheet; and a control unit that sets a number of slides at which the pressing unit is to slide on each of a plurality of sections of the folded side depending on a distance of each of the sections from a reference position, the number of slides at which the pressing unit slides on each of the respective plurality of section is decided independently thereof, and sets a length of each of the sections and controls the driving unit so as to slide in each of the sections for the number of slides set for the respective section.

17. The apparatus according to claim 1, wherein the folded side of the folded sheet is divided into a first section, a second section and a third section, the first section being closest to one end of the folded side has the same length as the third section being farthest to the other end of the folded side.

18. The apparatus according to claim 17, wherein the second section is calculated by subtracting the lengths of the first and second sections from the entire length of the folded side of the folded sheet.

* * * * *